US011676448B2

(12) United States Patent
Johnson

(10) Patent No.: US 11,676,448 B2
(45) Date of Patent: Jun. 13, 2023

(54) ENHANCED ELECTRONIC GAMING MACHINE OUT OF SERVICE MODE

(71) Applicant: IGT, Las Vegas, NV (US)

(72) Inventor: Paul Johnson, Reno, NV (US)

(73) Assignee: IGT, Las Vegas, NV (US)

( * ) Notice: Subject to any disclaimer, the term of this patent is extended or adjusted under 35 U.S.C. 154(b) by 20 days.

(21) Appl. No.: 17/387,524

(22) Filed: Jul. 28, 2021

(65) Prior Publication Data

US 2023/0032105 A1 Feb. 2, 2023

(51) Int. Cl.
*G07F 17/32* (2006.01)

(52) U.S. Cl.
CPC ..... *G07F 17/3227* (2013.01)

(58) Field of Classification Search
CPC ..... G07F 17/3227; G07F 17/32; G06N 20/00
See application file for complete search history.

(56) References Cited

U.S. PATENT DOCUMENTS

2007/0191090 A1 8/2007 O'Halloran et al.
2021/0280005 A1* 9/2021 Cleveland ..... G07F 17/3223

* cited by examiner

*Primary Examiner* — Kevin Y Kim
(74) *Attorney, Agent, or Firm* — Sheridan Ross P.C.

(57) ABSTRACT

The present disclosure relates generally to a gaming system, device, and method supportive of an enhanced electronic gaming machine "Out of Service" mode. A gaming system, device, and method are provided that receive a user input that invokes, for a player, a service mode for a gaming device during a gameplay session, place the gaming device into the service mode, generate an electronic record based on invoking the service mode for the player, and output a notification based on placing the gaming device into the service mode. The electronic record may include a set of parameters associated with the service mode. The notification may include information describing at least a portion of the electronic record.

20 Claims, 6 Drawing Sheets

600

ENHANCED ELECTRONIC GAMING MACHINE OUT OF SERVICE MODE

BACKGROUND

The present disclosure is generally directed toward gaming devices and systems and, more specifically, placing a gaming device (e.g., an Electronic Gaming Machine (EGM)) into an "Out of Service" mode.

Some EGMs are designed to include an "Out of Service" mode, where the EGM is not available for play. A floor attendant or other designated administrator is normally the only person allowed to place an EGM into the "Out of Service" mode via an operator menu.

BRIEF SUMMARY

In certain aspects, the present disclosure relates to a gaming system, device, and method supportive of an enhanced EGM "Out of Service" mode. Aspects of the present disclosure also relate to providing enhanced controls over an EGM's "Out of Service" mode.

A gaming system is provided that includes a processor; and a computer-readable storage medium coupled with the processor, the computer-readable storage medium including processor-executable instructions that, when executed by the processor, cause the processor to: receive a player input that invokes a service mode for a gaming device during a gameplay session; place the gaming device into the service mode; generate an electronic record based on invoking the service mode for the player; and output a notification based on placing the gaming device into the service mode. In some aspects, the electronic record may include a set of parameters associated with the service mode. In some examples, the notification may include information describing at least a portion of the electronic record.

A device is provided that includes: a communication interface; a processor coupled with the communication interface; and a computer-readable storage medium coupled with the processor, the computer-readable storage medium including processor-executable instructions that, when executed by the processor, cause the processor to: receive a player input that invokes a service mode for a gaming device during a gameplay session; place the gaming device into the service mode; generate an electronic record based on invoking the service mode for the player; and output a notification based on placing the gaming device into the service mode. In some aspects, the electronic record may include a set of parameters associated with the service mode. In some examples, the notification may include information describing at least a portion of the electronic record.

A method is provided that includes: receiving a player input that invokes a service mode for a gaming device during a gameplay session; placing the gaming device into the service mode; generating an electronic record based on invoking the service mode for the player; and outputting a notification based on placing the gaming device into the service mode. In some aspects, the electronic record may include a set of parameters associated with the service mode. In some aspects, the notification may include information describing at least a portion of the electronic record.

Additional features and advantages are described herein and will be apparent from the following Description and the figures.

DETAILED DESCRIPTION

Figure 1:
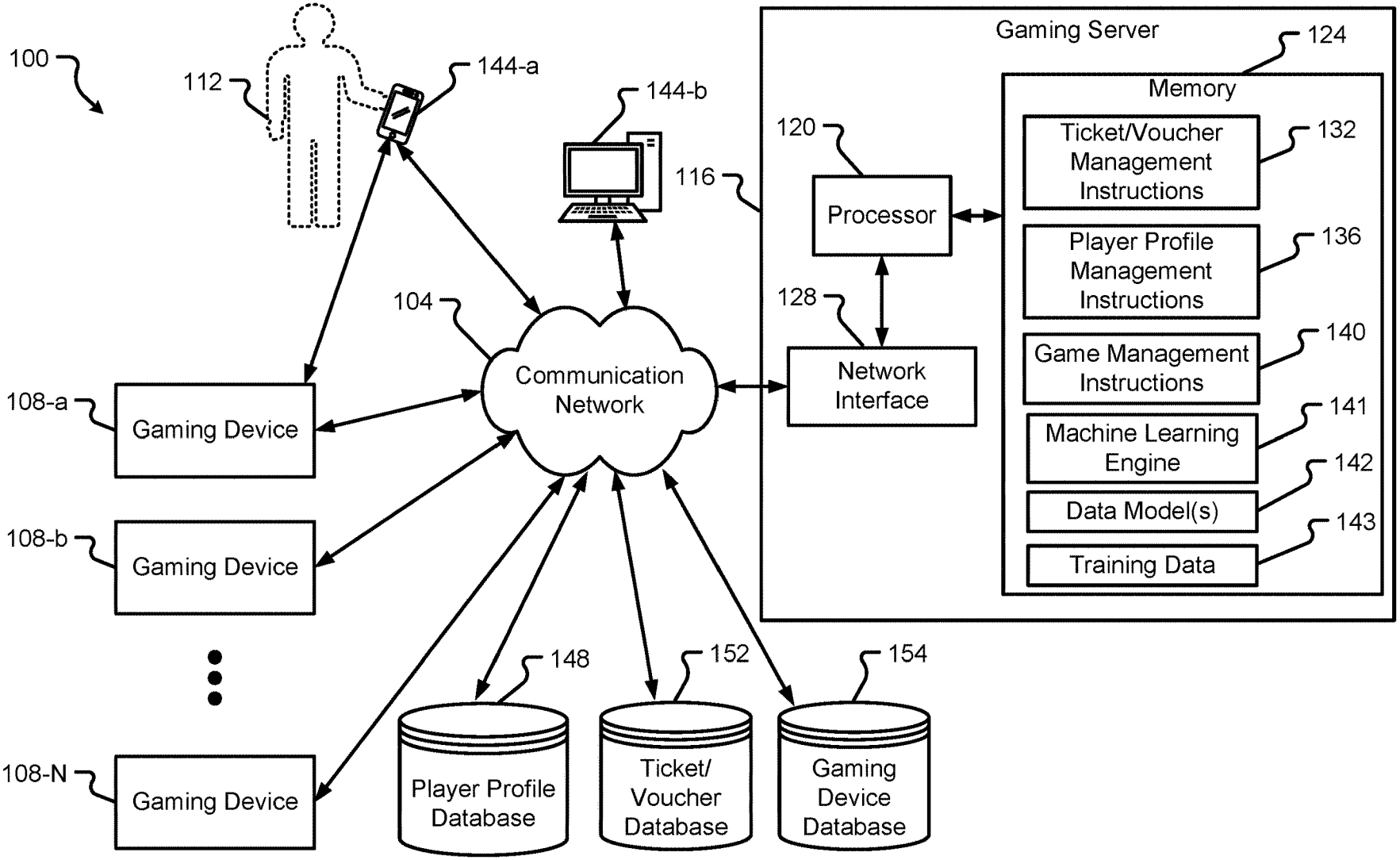
FIG. 1 is a block diagram of a gaming system in accordance with aspects of the present disclosure.

Aspects of the present disclosure will be described in connection with an enhanced "Out of Service" mode of a gaming device. While some examples in the present disclosure may reference the use of an Electronic Gaming Machine (EGM) as a gaming device via which players may participate in gaming activity, it should be appreciated that aspects of the present disclosure are not so limited. For example, any computing device, personal gaming device, or collection of computing devices may be used to facilitate invoking an "Out of Service" mode of a gaming device. Some gaming devices have a service mode that allows the gaming devices to be taken out of service and returned to service. A gaming device may be removed from service for any number of reasons, one of which is to hold the gaming device for a player for a period of time.

Aspects of the present disclosure provide enhancements to invoking an "Out of Service" mode and a "In Service" mode of a gaming device. In some examples, aspects of the present disclosure may support invoking the "Out of Service" mode and the "In Service" mode of the gaming device, with partial intervention from a floor attendant. In some other examples, aspects of the present disclosure may support invoking the "Out of Service" mode and the "In Service" mode by a player and/or a gaming system, without intervention from a floor attendant. In some other examples, aspects of the present disclosure may support invoking the "Out of Service" mode and the "In Service" mode by a player and/or a gaming system, based on an output by a machine learning network.

According to an example aspect of the present disclosure, a system is described which supports returning a gaming device (e.g., an EGM) to service by a player (e.g., via an electronic ticket or voucher), without intervention from a floor attendant. For example, during a gameplay session at a gaming device, a player may request for a floor attendant to remove the gaming device from service. The floor attendant may access the gaming device (e.g., via a set of physical keys, an access code, etc.) and invoke an "Out of Service" mode in an operator menu displayed at the gaming device. In an example, the gaming device may display the operator menu on a user interface of the gaming device. The operator menu may include, for example, a user interface for setting an "Out of Service" duration and for invoking the "Out of Service" mode.

Based on a user input by the floor attendant (e.g., setting the "Out of Service" duration and/or enabling the "Out of Service" mode), the gaming device may output a ticket associated with the "Out of Service" mode. The ticket may include information describing parameters associated with the "Out of Service" mode. For example, the parameters may include a "Return to Service" time, an "Out of Service" duration, or the like. In some cases, the ticket may include information associated with the gameplay session (e.g., remaining gameplay credits, balance information). Accordingly, for example, the player may step away from the gaming device (e.g., for a restroom break, meal break, extended departure, gameplay break, etc.) and later resume the gaming session (e.g., by inserting the ticket into the gaming device).

In an example, the ticket may be a physical ticket or voucher, an electronic ticket or voucher, combinations thereof, etc. (e.g., a Ticket-In-Ticket-Out (TITO) voucher). For example, the ticket may include an electronic display on which parameters associated with the "Out of Service" mode (e.g., "Return to Service" time, "Out of Service" duration, a countdown timer, gaming device identification information, etc.) are displayed. In some aspects, the ticket may be redeemed via (e.g., reinserted into) the gaming device or other gaming devices associated with the gaming system. In some other aspects, the ticket may be redeemable for cash at a cashier station, redeemable by floor attendants on a casino floor using wireless validation devices, or held by the player for later use (e.g., for use at the same gaming device or another gaming device).

Alternatively, or additionally, the gaming device may display the parameters associated with the "Out of Service" mode (e.g., "Return to Service" time, an "Out of Service" duration, a countdown timer, etc.) on a user interface of the gaming device. The user interface may include a display of the gaming device and/or another physical interface (e.g., a physical counter or indicator). Alternatively, or additionally, the server may display the parameters associated with the "Out of Service" mode (e.g., "Return to Service" time, an "Out of Service" duration, a countdown timer, etc.) on the server interface (e.g., player tracking service window on the gaming device). In an example, the player tracking service window may be included in a portion of a display (e.g., a main video display) of the gaming device or in a separate display on the gaming device. In some cases, the player tracking service window may be referred to as a players club service window.

In some examples, the system may support modifying (e.g., extending) the "Out of Service" duration of the gaming device. For example, based on an additional user input (e.g., modifying the "Return to Service" time, modifying the "Out of Service" duration) by the floor attendant of the casino, an employee of a restaurant associated with the casino (e.g., for examples in which the player may be unable to return to the gaming device by the "Return to Service" time), or a casino host, the gaming device may output an additional ticket associated with the "Out of Service" mode. The ticket may include updated information describing the parameters (e.g., "Return to Service" time, "Out of Service" duration) associated with the "Out of Service" mode.

The gaming device may remain in the "Out of Service" mode until one or more criteria is satisfied. For example, the player may resume the gameplay session by redeeming the ticket at the gaming device (e.g., inserting the ticket into the gaming device). In an example, based on the information on the ticket, the server (or the gaming device) may invoke the "In Service" mode of the gaming device (e.g., disable the "Out of Service" mode and reinitiate the gameplay session that was in progress prior to the gaming device being placed in the "Out of Service" mode). In some aspects, the gaming device may support a biometric input (e.g., a fingerprint, retina scan, etc.) for resuming the gameplay session.

In another example, if the player fails to return to the gaming device prior to the "Return to Service" time (e.g., before the "Out of Service" duration elapses), the server (or the gaming device) may automatically invoke the "Return to Service" mode of the gaming device, and the gaming device may be available to any player and the previous gameplay session may be discontinued.

In another example, a server in communication with the gaming device may invoke the "In Service" mode of the gaming device if the player inserts the ticket into another gaming device during the "Out of Service" duration. For example, based on insertion of the ticket into the other gaming device, the server may end the gameplay session associated with the player and the gaming device, and the server may initiate a new gameplay session at the other gaming device in association with the player. In some cases, the system may support the transfer of credits between gaming devices based on the insertion of the ticket into the other gaming device. For example, the credit meters at the gaming device and the other gaming device may be updated (e.g., by the server, by the gaming devices) to reflect the credit transfer.

In some cases, the server may issue a notification (e.g., via the other gaming device, via a communication device of the player, etc.) to the player that the gaming device held in the "Out of Service" mode will be returned to service. In some additional aspects, the system may provide (e.g., via the notification) an option to cancel the transfer of the gameplay session and associated credits. For example, the server may provide and inform (e.g., via the notification) the player with a duration for cancelling the transfer, before proceeding with the transfer. In an example, the server may proceed with the transfer based on a player input confirming the transfer or based on an expiration of the duration for cancelling the transfer.

In some other examples, if the player redeems (e.g., cashes out) the ticket prior to the "Return to Service" time (e.g., before the "Out of Service" duration elapses), the server may automatically invoke the "In Service" mode of the gaming device, and the gaming device may be available to any player.

According to another example aspect of the present disclosure, the system may support taking a gaming device out of service (e.g., invoking the "Out of Service" mode) and/or returning the gaming device to service (e.g., invoking the "In Service" mode) by a player, without intervention from a floor attendant. For example, during a gameplay session at a gaming device, the server, the gaming device, and/or a communication device may output a notification to the player for removing the gaming device from service (e.g., "holding the gaming device" for the player). The notification may include any combination of visual, audible, and haptic notifications. In an example, the server (through the player tracking service window or another interface), the gaming device, and/or the communication device may output the notification based on whether the "Out of Service" mode is available to the player. The notification may include an indication that the "Out of Service" mode is available to the player.

In some aspects, the gaming device may include a user interface (e.g., a display, virtual buttons) for setting an "Out of Service" duration and for invoking the "Out of Service" mode. In an example, the gaming device may display the notification on the user interface (e.g., display) of the gaming device. In another aspect, the gaming device may include a physical interface (e.g., buttons, switches, etc.) for invoking the "Out of Service" mode. In an example, the gaming device may illuminate a portion of the physical interface based on whether the "Out of Service" mode is available to the player. In another example, the player tracking service window may provide the interface for setting, invoking, and/or ending the "Out of Service" mode.

In some aspects, the server (or the gaming device) may generate and output the notification based on gameplay data associated with a gameplay session. For example, the server (or the gaming device) may provide the player with an option of invoking the "Out of Service" mode based on whether the gameplay data satisfies one or more conditions. In an example, providing the option of invoking the "Out of Service" mode may include enabling selection of the "Out of Service" mode and/or selection of parameters associated with the "Out of Service" mode.

In an example, the server (or the gaming device) may generate and output the notification when a quantity of plays (e.g., spins, pulls, bets, etc.) associated with the gameplay session is equal to or greater than a threshold quantity of plays. In another example, the server (or the gaming device) may generate and output the notification when a quantity of credits played during the gameplay session is equal to or greater than a threshold quantity of credits. In other examples, the server (or the gaming device) may generate and output the notification when a duration of the gameplay session (e.g., player time at the gaming device) is equal to or greater than a temporal threshold.

In some cases, the system may support providing players with the option of invoking the "Out of Service" mode based on membership status (e.g., player club status) associated with the player. In some other cases, the system may support providing players with the option of invoking the "Out of Service" mode, regardless of membership status (e.g., to any player). In an example, the system may support providing the option of invoking the "Out of Service" mode as a free feature to all players or as a paid feature (e.g., fee-based).

The server (or the gaming device) may calculate or set the "Out of Service" duration based on the gameplay data associated with the gameplay session and/or user profile information associated with the player. For example, the server (or the gaming device) may set the "Out of Service" duration based on whether the gameplay data satisfies one or more conditions.

In an example, the server (or the gaming device) may provide a relatively shorter "Out of Service" duration (e.g., restroom break, 10 minutes) based on gameplay sessions that are equal to or greater than a threshold temporal duration (e.g., 1 hour). In another example, the server (or the gaming device) may provide a relatively longer "Out of Service" duration (e.g., meal break, 90 minutes) based on gameplay sessions that are equal to or greater than another threshold temporal duration (e.g., 3 hours).

In some aspects, the system may support setting a quantity of instances that a player may invoke the "Out of Service" with respect to each type of "Out of Service" duration. For example, a server (or the gaming device) may provide a player with the relatively shorter "Out of Service" duration (e.g., restroom break, 10 minutes, etc.) once every hour. In another example, the server (or the gaming device) may provide the player with the relatively longer "Out of Service" duration (e.g., meal break, 90 minutes) once per day.

In some cases, the system may support providing different "Out of Service" durations based on the status level (e.g., player club status) of a player and/or player tracking status (e.g., average credits gambled over time at a casino, net credits won during a visit, etc.). For example, the server (or the gaming device) may provide an "Out of Service" duration equal to 90 minutes or longer for a player of a status level (e.g., gold or platinum member) or higher. In another example, the server (or the gaming device) may provide "Out of Service" durations equal to 12 hours or longer (e.g., an "overnight hold") for a player that has wagered a quantity of credits or higher (e.g., a "high roller" player).

Based on a user input by the player, the server (or the gaming device) may set the "Out of Service" duration and/or invoke the "Out of Service" mode of the gaming device. In an example, the gaming device may output a ticket as described herein in association with the "Out of Service" mode. The ticket may include example aspects of an electronic ticket or voucher (e.g., TITO voucher) described herein.

Alternatively, or additionally, the gaming device may display the parameters associated with the "Out of Service" mode (e.g., "Return to Service" time, an "Out of Service" duration, a countdown timer, etc.) on a user interface of the gaming device as described herein.

The system may support modifying (e.g., extending) the "Out of Service" mode by a player. For example, the gaming device may display a menu (e.g., on the user interface) and/or include physical buttons (e.g., on the physical interface) via which the player may extend the "Out of Service" duration. Based on a user input that extends the "Out of Service" mode, the gaming device may output a corresponding additional ticket.

The gaming device may remain in the "Out of Service" mode until one or more criteria is satisfied as described herein (e.g., insertion of the ticket into the gaming device, the "Out of Service" duration elapses, insertion of the ticket into another gaming device, redemption (cash out) of the ticket, etc.). In some aspects, the system may support returning the gaming device to service (e.g., invoking the "In Service" mode) based on one or more user inputs by the player. For example, the gaming device may display a menu and/or include physical buttons via which the player may enter an access code (e.g., a personal identification (PIN) code) for returning the gaming device to service.

In some aspects, the server (or the gaming device) may invoke the "In Service" mode of the gaming device based on verifying the access code. In some other aspects, the player may both enter an access code and insert a ticket associated with the "Out of Service" mode, and the server (or the gaming device) may invoke the "In Service" mode of the gaming device based on verifying the access code and the ticket.

According to another example aspect of the present disclosure, managing the "Out of Service" mode and "In Service" mode of a gaming device may be implemented at a communication device of a player and/or a user interface of the gaming device, without intervention from a floor attendant. For example, the system may support taking a gaming device out of service (e.g., invoking the "Out of Service" mode) and/or returning the gaming device to service (e.g., invoking the "In Service" mode) by a player, via a mobile application at the communication device and/or the user interface of the gaming device.

The mobile application may support "carding in" of the player into the gaming device without a physical card (e.g., a player club card). In some aspects, the mobile application may support fund transfers between a player account and the gaming device (e.g., a server, the casino). For example, using the mobile application, the player may transfer funds to a gaming session. In an example of "carding in," the communication device may exchange information with the gaming device over a wireless connection (e.g., near field communication (NFC), Bluetooth, etc.) when the communication device is within a threshold distance of the gaming device. In another aspect, the communication device may "card in" and exchange information with the gaming device when the communication device is connected to the gaming device using a physical communications link (e.g., a communications cable). In an example, when "carding in," the communication device may provide player identification information (e.g., player identity, player club status, player preference information, etc.) to the gaming device, the server, and/or the gaming system. The server (or the gaming device) may establish a gaming session at the gaming device for the player based on the information provided during the "card in".

For example, during a gameplay session at a gaming device, the communication device may output a notification to the player for removing the gaming device from service (e.g., "holding the gaming device" for the player). The notification may include any combination of visual, audible, and haptic notifications. In an example, the communication device may output the notification based on whether the "Out of Service" mode is available to the player. The notification may include an indication that the "Out of Service" mode is available to the player. The notification may include the information described herein with respect to the parameters associated with the "Out of Service" mode.

In some aspects, the communication device may include a user interface (e.g., a display, virtual buttons) for setting an "Out of Service" duration and for invoking the "Out of Service" mode. In an example, the communication device may display the notification on the user interface (e.g., display) of the communication device. In another aspect, the communication device may include a physical interface (e.g., buttons, switches, etc.) for setting the "Out of Service" duration and for invoking the "Out of Service" mode. In an example, the communication device may illuminate a portion of the physical interface based on whether the "Out of Service" mode is available to the player.

The server (or the gaming device) may generate and output the notification to the communication device. The server (or the gaming device) may generate and/or output the notification to the communication device, for example, based on gameplay data associated with a gameplay session as described herein. In an example, the communication device may display the notification to the user via the user interface.

In some aspects, via the user interface, the player may invoke the "Out of Service" mode and/or set parameters (e.g., duration) associated with the "Out of Service" mode. In an example, invoking the "Out of Service" mode may be enabled by the server (or the gaming device) for the player based on gameplay data (e.g., quantity of plays with respect to a threshold quantity, gameplay duration with respect to a temporal threshold, credits played) and/or user profile information (e.g., membership status) described herein.

Based on a user input via the user interface of the communication device, the server (or the gaming device) may set the "Out of Service" duration and/or invoke the "Out of Service" mode of the gaming device. In an example, the communication device may display any combination of parameters described herein in association with the "Out of Service" mode (e.g., "Return to Service" time, "Out of Service" duration, gaming device identification information, credits remaining, etc.).

In some aspects, the communication device may support (e.g., via the user interface) example aspects described herein of setting the "Out of Service" duration, invoking the "Out of Service" mode, modifying (e.g., extending) the "Out of Service" mode, invoking the "In Service" mode of the gaming device (e.g., ending the "Out of Service" mode), transferring the "Out of Service" mode to another gaming device, and/or redeeming credits associated with the gameplay session.

For example, the gaming device may remain in the "Out of Service" mode until one or more criteria is satisfied. For example, the server (or the gaming device) may return the gaming device to service (e.g., invoking the "In Service" mode) based on an expiry of the "Out of Service" duration.

In another example, the server (or the gaming device) may return the gaming device to service based on one or more user inputs by the player. For example, the user interface of the communication device may include a user interface (e.g., a menu) and/or other physical interface (e.g., buttons, switches) via which the player may return the gaming device to service. The server (or the gaming device) may return the gaming device to service based on a user input (e.g., for invoking the "Return to Service" mode) and/or an access code (e.g., a personal identification (PIN) code) entered via the user interface.

In some other cases, the server (or the gaming device) may return the gaming device to service based at least in part on a "card in" event (e.g., NFC data exchange) at the gaming device using the communication device. In some examples, the server (or the gaming device) may return the gaming device to service based at least in part on a "card in" event (e.g., NFC data exchange) at another gaming device and/or redemption of credits (e.g., using the communication device) associated with the gameplay session.

In some cases, the server (or the gaming device) may output a notification to the communication device based on the elapsed time (e.g., remaining amount of time) with respect to the "Out of Service" mode. For example, if the remaining amount of time is less than a threshold value, the server (or the gaming device) may output a notification to the communication device indicative of the pending expiry of the "Out of Service" mode. The communication device may display the notification (e.g., via a user interface). In an example, the notification may include a user interface (e.g., a menu) via which the player may extend the duration of the "Out of Service" mode.

Alternatively, or additionally, the gaming system may support setting the "Out of Service" duration, invoking the "Out of Service" mode, modifying (e.g., extending) the "Out of Service" mode, and/or invoking the "Return to Service" mode of the gaming device via a combination of inputs at the user interface of the communication device and the user interface of the gaming device.

According to other example aspects of the present disclosure, the gaming system may support autonomously and/or semi-autonomously managing the "Out of Service" mode and "Return to Service" mode of a gaming device as described herein (e.g., without intervention from a floor attendant, with partial or no intervention from a player) based on an analysis of gameplay data by a machine learning network included in the gaming system.

In an example, the machine learning network may be implemented at the server and/or the gaming device. The server (or the gaming device) may provide, to the machine learning network, gameplay data (e.g., player information, quantity of plays, duration of gameplay, credits spent, credits earned, etc.) associated with a gameplay session at the gaming device. In some aspects, the server (or the gaming device) may provide, to the machine learning network, a set of criteria associated with managing the service mode. The machine learning network may process the gameplay data and determine whether the gameplay data satisfies the set of criteria.

In an example, the server may receive an output from the machine learning network in response to the machine learning network processing the data with respect to the set of criteria. The output may include an indication associated with managing the service mode (e.g., an indication to invoke an "Out of Service" mode, an indication to invoke a "Return to Service" mode). For example, the server may enable selection of the "Out of Service" mode based on whether the status level (e.g., player club status) of the player is a status level (e.g., gold or platinum member) or higher. In another example, the server may make the "Out of Service" mode available to the player based on whether the gameplay data satisfies the set of criteria (e.g., threshold quantity of plays, threshold gameplay duration, threshold quantity of credits spent, threshold quantity of credits earned, etc.). In some other examples, the machine learning network may predict user behavior associated with a gameplay session (e.g., user decision to take a break and hold the machine after a quantity of plays, a gameplay duration, a losing streak, etc.), and the server may make the "Out of Service" mode available to the player based on the prediction.

In some aspects, the output may include a predicted parameter value(s) of parameters (e.g., "Return to Service" time, "Out of Service" duration) associated with the service mode. In some cases, the output may include predicted user decisions (e.g., user behavior) with respect to the "Out of Service" mode (e.g., user inputs to invoke the "Out of Service" mode, modify the "Out of Service" mode, and/or invoke the "In Service" mode of the gaming device).

The machine learning network may predict the user behavior, the parameter value(s), and/or user decisions based on one or more data models described herein. The data models may be trained based on training data collected at the gaming device, the server, or a communication device. In some examples, the training data may include player inputs (e.g., player decisions, player behavior) with respect to previous and/or current instances of an invoked "Out of Service" mode associated with a gameplay session at a gaming device.

In some aspects, for previous instances in which an "Out of Service" mode was invoked at a gaming device, and the player visited a restaurant during the "Out of Service" duration, the training data may include player travel time between the gaming device and the restaurant. In some aspects, the training data may include historical and/or live visit data associated with the restaurant. The visit data may include, for example, "peak" durations (e.g., busy times), "off-peak" durations (e.g., relatively less busy times), wait times, wait time estimates, etc. of the restaurant. In some cases, the training data may include travel distance between the gaming device and the restaurant.

In an example, based on the training data (e.g., player travel time, visit data of the restaurant, travel distance, etc.), the machine learning network may predict user decisions of the player with respect to invoking an "Out of Service" mode, modifying the "Out of Service" mode, and/or invoking the "In Service" mode at the gaming device. For example, the machine learning network may predict that the player may invoke an "Out of Service" mode during a gameplay session and visit a restaurant. In some cases, the machine learning network may output a suggested "Out of Service" duration based on predicted user decisions associated with visiting the restaurant and returning to the gaming device. In some other cases, the machine learning network may automatically extend the "Out of Service" duration and/or transmit a notification to a communication device of the player for extending the "Out of Service" duration.

The server may manage the service mode of the gaming device based on the output from the machine learning network. For example, the server may set parameters values (e.g., duration) associated with the "Out of Service" mode, invoke the "Out of Service" mode, modify (e.g., extend) the "Out of Service" mode, invoke the "In Service" mode of the gaming device, and/or transfer gameplay data associated with the "Out of Service" mode as described herein based on the output from the machine learning network.

In some aspects, the communication device and/or the gaming device may output a notification to the player for removing the gaming device from service (e.g., "holding the gaming device" for the player), based on the output from the machine learning network. In some examples, the notification may include parameters (e.g., duration, gaming device identification information, etc.) associated with the "Out of Service" mode.

Aspects of invoking the "Out of Service" mode at a gaming device may be implemented as a selectable feature available to all players at the gaming device (e.g., on a touchscreen, a physical button, or the like). In another example, aspects of invoking the "Out of Service" mode at a gaming device may be implemented as a selectable feature associated with a player tracking system (e.g., via a player tracking mobile application, a service window of the gaming device, and/or another location on the gaming device). In another example, aspects of invoking the "Out of Service" mode at a gaming device may be implemented as a selectable feature associated with a cashless play system (e.g., via a mobile cashless device associated with cashless connect, resort wallet, etc., via the gaming device when the cashless system is used). In some cases, options associated with invoking the "Out of Service" mode may be configurable based on criteria (e.g., time played, cash played, player club status, etc.) set by a casino and/or a casino operator.

Example aspects of taking a gaming device out of service (e.g., invoking the "Out of Service" mode) and/or returning the gaming device to service (e.g., invoking the "In Service" mode) based on an output from the machine learning network will be described herein with reference to corresponding figures.

Aspects of the subject matter described herein may reduce employee overhead associated with allocating floor attendants for invoking an "Out of Service" mode and/or invoking a "In Service" mode at a gaming device. In some other cases, the techniques described herein may improve player convenience by removing the reliance on a floor attendant to invoke the "Out of Service" mode and/or invoke the "In Service" mode. Additionally, the techniques described herein may support player convenience for players wishing to play a gaming device that is held in an "Out of Service" mode for another player (e.g., by returning the gaming device to service when the "Out of Service" duration is exceeded).

With reference initially to FIG. 1, details of an illustrative gaming system 100 will be described in accordance with at least some embodiments of the present disclosure. The components of the gaming system 100, while depicted as having particular instruction sets and devices, are not necessarily limited to the examples depicted herein. Rather, a system according to embodiments of the present disclosure may include one, some, or all of the components depicted in the gaming system 100 and does not necessarily have to include all of the components in a single device. For example, the components of a server may be distributed amongst a plurality of servers and/or other devices (e.g., a gaming device, a portable user device, etc.) in the gaming system 100 without departing from the scope of the present disclosure.

The gaming system 100 may include a communication network 104 that interconnects and facilitates machine-to-machine communications between one or multiple gaming devices 108 (e.g., any of gaming device 108-*a* through 108-N) and a gaming server 116. It should be appreciated that the communication network 104 may correspond to one or many communication networks without departing from the scope of the present disclosure. In some embodiments, gaming device 108-*a* through gaming device 108-N and gaming server(s) 116 may be configured to communicate using various nodes or components of the communication network 104. The communication network 104 may include any type of known communication medium or collection of communication media and may use any type of protocols to transport messages between endpoints. The communication network 104 may include wired and/or wireless communication technologies. The Internet is an example of the communication network 104 that constitutes an Internet Protocol (IP) network consisting of many computers, computing networks, and other communication devices located all over the world, which are connected through many telephone systems and other means. Other examples of the communication network 104 include, without limitation, a standard Plain Old Telephone System (POTS), an Integrated Services Digital Network (ISDN), the Public Switched Telephone Network (PSTN), a Local Area Network (LAN), a Wide Area Network (WAN), a cellular network, and any other type of packet-switched or circuit-switched network known in the art. In addition, it can be appreciated that the communication network 104 need not be limited to any one network type, and instead may be comprised of a number of different networks and/or network types. Moreover, the communication network 104 may include a number of different communication media such as coaxial cable, copper cable/wire, fiber-optic cable, antennas for transmitting/receiving wireless messages, and combinations thereof.

In some embodiments, the gaming devices 108 (e.g., gaming device 108-*a* through gaming device 108-N) may be distributed throughout a single property or premises (e.g., a single casino floor), or the gaming devices 108 (e.g., gaming device 108-*a* through gaming device 108-N) may be distributed among a plurality of different properties. In a situation where the gaming devices 108 are distributed in a single property or premises, the communication network 104 may include at least some wired connections between network nodes. As a non-limiting example, the nodes of the communication network 104 may communicate with one another using any type of known or yet-to-be developed communication technology. Examples of such technologies include, without limitation, Ethernet, SCSI, PCIe, RS-232, RS-485, USB, ZigBee, WiFi, CDMA, GSM, HTTP, TCP/IP, UDP, etc.

The gaming devices 108 (e.g., gaming device 108-*a* through gaming device 108-N) may utilize the same or different types of communication protocols to connect with the communication network 104. It should also be appreciated that the gaming devices 108 (e.g., gaming device 108-*a* through gaming device 108-N) may present the same type of game or different types of games to a player 112. For example, the gaming device 108-*a* may correspond to a gaming machine that presents a slot game to the player 112, the gaming device 108-*b* may correspond to a video poker machine, and other gaming devices 108 may present other types of games or a plurality of different games for selection and eventual play by the player 112.

In some aspects, some of the gaming devices 108 (e.g., gaming device 108-*a* through gaming device 108-N) may communicate or exchange data with one another via the communication network 104. In some embodiments, one or more of the gaming devices 108 may be configured to communicate directly with a centralized management server and/or the gaming server 116. Although not depicted, the gaming system 100 may include a separate server or collection of servers that are responsible for managing the operation of the various gaming devices 108 in the gaming system 100.

It should also be appreciated that the gaming server 116 may or may not be co-located with one or more gaming devices in the same property or premises. Thus, one or more gaming devices may communicate with the gaming server 116 over a WAN, such as the Internet. In such an event, a tunneling protocol or Virtual Private Network (VPN) may be established over a portion of the communication network 104 to ensure that communications between an EGM and the server 116 (e.g., a remotely-located server) are secured.

The gaming devices 108 (e.g., gaming device 108-*a* through gaming device 108-N) may correspond to a type of device that supports interaction by a player 112 in connection with playing games of chance. Examples of a gaming device 108 may include any type of known gaming device such as an EGM, a slot machine, a table game, an electronic table game (e.g., video poker), a skill-based game, etc. In addition to playing games on a gaming device 108, the player 112 may also be allowed to interact with and play games of chance on a communication device 144.

The gaming system 100 may support interaction with one or more communication devices 144. A communication device 144 (e.g., communication device 144-*a*) may be a mobile device of a player 112 (e.g., a personal communication device such as a smart phone, a tablet, a smart watch, etc.) or to a device issued by a casino to the player 112. It should be appreciated that the player 112 may play games directly on the communication device 144. Alternatively, or additionally, the communication device 144 may establish a communications (e.g., over a wireless or wired connection) with a gaming device 108 such that the communication device 144 provides an interface for the player 112 to interact with the gaming device 108. As shown in FIG. 1, the communication device 144 may be in communication with the communication network 104 or in direct communication (e.g., via Bluetooth, WiFi, etc.) with a gaming device 108. Non-limiting examples of a communication device 144 include a cellular phone, a smart phone, a tablet, a wearable device, an augmented reality headset, a virtual reality headset, a laptop, a Personal Computer (PC), or the like. In some cases, another communication device 144 (e.g., communication device 144-*b*) may be a mobile device, a PC, or the like of a casino operator (e.g., a floor attendant, a casino manager, etc.).

The gaming server 116 is further shown to include a processor 120, a memory 124, and a network interface 128. These resources may enable functionality of the gaming server 116 as will be described herein. For example, the network interface 128 provides the server 116 with the ability to send and receive communication packets or the like over the communication network 104. The network interface 128 may be provided as a network interface card (NIC), a network port, drivers for the same, and the like. Communications between the components of the server 116 and other devices connected to the communication network 104 may all flow through the network interface 128.

The processor 120 may correspond to one or many computer processing devices. For example, the processor 120 may be provided as silicon, as a Field Programmable Gate Array (FPGA), an Application-Specific Integrated Circuit (ASIC), any other type of Integrated Circuit (IC) chip, a collection of IC chips, a microcontroller, a collection of microcontrollers, or the like. As a more specific example, the processor 120 may be provided as a microprocessor, Central Processing Unit (CPU), or plurality of microprocessors that are configured to execute the instructions sets stored in memory 124. Upon executing the instruction sets stored in memory 124, the processor 120 enables various authentication functions of the gaming server 116.

The memory 124 may include any type of computer memory device or collection of computer memory devices. The memory 124 may be volatile or non-volatile in nature and, in some embodiments, may include a plurality of different memory devices. Non-limiting examples of memory 124 include Random Access Memory (RAM), Read Only Memory (ROM), flash memory, Electronically-Erasable Programmable ROM (EEPROM), Dynamic RAM (DRAM), etc. The memory 124 may be configured to store the instruction sets depicted in addition to temporarily storing data for the processor 120 to execute various types of routines or functions. Although not depicted, the memory 124 may include instructions that enable the processor 120 to store data to and retrieve data from a player profile database 148, a ticket/voucher database 152, and/or a gaming device database 154.

Alternatively or additionally, the player profile database 148 or data stored thereon may be stored internal to the server 116 (e.g., within the memory 124 of the server 116 rather than in a separate database). Alternatively or additionally, the ticket/voucher database 152 or data stored therein may be stored internal to the server 116. Alternatively or additionally, the gaming device database 154 or data stored thereon may be stored internal to the server 116.

The databases described herein (e.g., player profile database 148, ticket/voucher database 152, gaming device database 154) may include a relational database, a centralized database, a distributed database, an operational database, a hierarchical database, a network database, an object-oriented database, a graph database, a NoSQL (non-relational) database, etc. In some aspects, the databases may store and provide access to, for example, any of the stored data described herein.

The illustrative instruction sets that may be stored in memory 124 include, without limitation, a ticket/voucher management instruction set 132, a player profile management instruction set 136, and a game management instruction set 140. Functions of the server 116 enabled by these various instruction sets will be described in further detail herein. It should be appreciated that the instruction sets depicted in FIG. 1 may be combined (partially or completely) with other instruction sets or may be further separated into additional and different instruction sets, depending upon configuration preferences for the server 116. Said another way, the particular instruction sets depicted in FIG. 1 should not be construed as limiting embodiments described herein.

In some embodiments, the ticket/voucher management instruction set 132, when executed by the processor 120, may enable the gaming server 116 to manage various tickets/vouchers issued by gaming devices 108 (e.g., gaming device 108-*a* through gaming device 108-N), manage ticket/voucher values, determine ticket/voucher states, update the ticket/voucher database 152, obtain information from the ticket/voucher database 152, determine that a ticket/voucher has been redeemed and notify the player profile management instruction set 136, etc. In embodiments where the ticket/voucher instruction set 132 is implemented in one system (e.g., a ticketing/voucher system) and the player profile management instruction set 136 is implemented in a separate system (e.g., a player tracking system), a communication link may or may not be implemented between the two systems. In such a situation, the tickets/vouchers issued by the ticketing/voucher system may be anonymous and not necessarily associated with any particular player or player profile.

In some cases, the ticket/voucher values may indicate available gameplay credits associated with a gameplay session at a gaming device 108. For example, when a gaming device 108 is in a "Out of Service" mode (e.g., the gaming device 108 is removed from service and "held" for a player), the ticket/voucher values may indicate available gameplay credits associated with the gameplay session, the player, and the gaming device 108.

In some embodiments, the ticket/voucher management instruction set 132 may be configured to perform any action consistent with the issuance of tickets/vouchers, tracking of ticket/voucher states, and determining whether/when/where a ticket/voucher has been redeemed. In some embodiments, the ticket/voucher management instruction set 132 may be configured to generate, or cause the game management instruction set 140 to generate, a synthesized credit meter for the first gaming device. For example, as gaming devices 108 (e.g., gaming device 108-*a* through gaming device 108-N) or a communication device 144 have their credit meters updated, the gaming server 116 may update a corresponding synthesized credit meter to reflect updates at the credit meters. In some embodiments, values of credit or other events stored in credit meters of gaming device 108 and/or a communication device 144 may be mirrored in a synthesized credit meter maintained by the gaming server 116.

In some aspects, the ticket/voucher management instruction set 132, when executed by the processor 120, may enable the gaming server 116 to manage values of credit associated with a gameplay session at a gaming device 108. For example, the gaming server 116 may support the transfer of credits between gaming devices 108 when transferring data associated with an "Out of Service" mode from a gaming device 108 (e.g., gaming device 108-*a*) to another gaming device 108 (e.g., gaming device 108-*b*) as described herein. The gaming server 116 may update a corresponding synthesized credit meter with respect to the transfer of credits between the gaming devices 108, reflecting updates at the corresponding credit meters of the gaming devices 108.

The player profile management instruction set 136, when executed by the processor 120, may enable the gaming server 116 to manage one or more player profiles within the player profile database 148. In some embodiments, the player profile management instruction set 136 may be configured to manage a player loyalty profile including settings for such player profiles, available wager credits for such profiles, determine player wager history, and/or determine which, if any, tickets/vouchers are associated with a particular player. It should also be appreciated that the player profile management instruction set 136 may be configured to manage player profiles of players that do not have loyalty accounts or any other predetermined player account.

In some aspects, the player profile management instruction set 136 may be configured to manage a player history associated with gameplay sessions and instances of "Out of Service" mode(s) invoked (e.g., directly by the player and/or via a floor attendant) on behalf of the player. In an example, the player history may include user behavior associated with previous and/or current gameplay sessions (e.g., user decisions to take a break and hold the machine after a quantity of plays, a gameplay duration, a losing streak, etc.). In some aspects, the player history may include player behavior away from a gaming device 108 when the gaming device 108 is held in the "Out of Service" mode for the player. The player behavior away from the gaming device 108 may include, for example, retail transactions at a casino (e.g., a meal purchase, duration of meal break) while the gaming device 108 is held in the "Out of Service" mode. In some cases, the gaming server 116 may determine the player behavior away from the gaming device 108 based on player activity included in the player loyalty profile.

The game management instruction set 140, when executed by the processor 120, may enable the gaming server 116 to manage the various games played by a player 112 at the gaming devices 108 (e.g., gaming device 108-*a* through gaming device 108-N) and/or a communication device 144 carried by the player 112. For example, any game played by the player 112 at any of the gaming devices 108 and/or communication device 144 may be managed, partially or entirely, by execution of the game management instruction set 140. The game management instruction set 140 may also be configured to track a status of wager events (e.g., sporting events, bingo, keno, lottery, etc.) and whether a player 112 has placed a wager on such events. In some embodiments, when a wager event has come to completion such that wagers made on the event become payable (e.g., at the end of a gameplay decision at a gaming device 108 and/or communication device 144, at the end of a sporting event when the final score of the event is determined), the game management instruction set 140 may notify the ticket/voucher management instruction set 132, thereby enabling the ticket/voucher management instruction set 132 to update states and/or values of tickets/vouchers issued for the event appropriately.

In some aspects, the game management instruction set 140, when executed by the processor 120, may enable the gaming server 116 to manage and/or monitor data associated with a gameplay session at a gaming device 108. For example, the gaming server 116 may support example aspects described herein of monitoring player information (e.g., member identification information, player club status, etc.), gameplay data (e.g., quantity of plays, duration of gameplay, credits spent, credits earned, etc.), and service mode information (e.g., current service mode, identification information of the gaming device, etc.) associated with a gameplay session at the gaming device 108. In an example, the gaming server 116 may support example aspects described herein of setting parameters (e.g., duration) of an "Out of Service" mode for a gaming device 108, invoking the "Out of Service" mode at the gaming device 108, modifying (e.g., extending) the "Out of Service" mode of the gaming device 108, invoking a "Return to Service" mode of the gaming device 108, and/or transferring the "Out of Service" mode to from the gaming device 108 to another gaming device 108. The gaming server 116 may update the gaming device database 154, obtain information from the gaming device database 154, determine gaming devices 108 that are in an "Out of Service" mode or a "In Service" mode, and notify the game management instruction set 140, etc.

In some examples, the game management instruction set 140 may enable the gaming server 116 to manage and/or access criteria associated with managing "Out of Service" modes and/or "Return to Service" modes of gaming devices 108. The criteria may be stored in the memory 124, a memory of another device (e.g., another server, a communication device 144, a gaming device 108, a database, etc.). In an example, the gaming server 116 may support example aspects described herein of setting parameters (e.g., duration) of an "Out of Service" mode for a gaming device 108, invoking the "Out of Service" mode at the gaming device 108, modifying (e.g., extending) the "Out of Service" mode of the gaming device 108, invoking a "Return to Service" mode of the gaming device 108, and/or transferring the "Out of Service" mode to from the gaming device 108 to another gaming device 108 based on whether gameplay data associated with a gameplay session satisfies the criteria. The gaming server 116 may support examples aspects described herein of notifying a player of information associated with an "Out of Service" mode (e.g., whether the "Out of Service" mode is available to the player, whether the "Out of Service" mode has been invoked, ended, and/or transferred, parameters associated with the "Out of Service" mode, etc.).

According to example aspects of the present disclosure, the processor 120 may utilize data stored in the memory 124 as a neural network. The neural network may be, for example, a machine learning network and may include a machine learning architecture. In some aspects, the neural network may be or include an artificial neural network (ANN). In some other aspects, the neural network may be or include any machine learning network such as, for example, a deep learning network, a convolutional neural network, or the like. Some or all of instructions or instruction sets stored in the memory 124 and some functions of the gaming server 116, gaming devices 108, and/or communication devices 144 may be implemented using machine learning techniques.

The memory 124 may be configured to store program instructions (instruction sets) that are executable by the processor 120 and provide functionality of a machine learning engine 141. The memory 124 may also be configured to store data or information that is useable or capable of being called by the instructions stored in memory 124. One example of data that may be stored in memory 124 for use by components thereof is a data model(s) 142 and/or training data 143. The data model(s) 142 may be a neural network model. The training data 143 may include training data and feedback.

The machine learning engine 141 may include a single or multiple engines. The gaming server 116 (e.g., the machine learning engine 141) may utilize one or more data models 142 for recognizing and processing information obtained from gaming devices 108, communication devices 144, other servers, and/or databases (e.g., player profile database 148, ticket/voucher database 152). In some aspects, the gaming server 116 (e.g., the machine learning engine 141) may update one or more data models 142 based on learned information included in the training data 143. In some aspects, the machine learning engine 141 and the data models 142 may support forward learning based on the training data 143. The machine learning engine 141 may have access to and use one or more data models 142. For example, the data model(s) 142 may be built and updated by the machine learning engine 141 based on the training data 143. The data model(s) 142 may be provided in any number of formats or forms. Non-limiting examples of the data model(s) 142 include autoregressive models, Decision Trees, Support Vector Machines (SVMs), Nearest Neighbor, and/or Bayesian classifiers.

In some examples, the training data 143 may include any data managed by the gaming server 116 with respect to the ticket/voucher management instruction set 132, the player profile management instruction set 136, and/or the game management instruction set 140 described herein. For example, the training data 143 may include player histories associated with gameplay sessions and previously invoked "Out of Service" modes (e.g., gameplay data, player behavior away from a gaming device 108 during an "Out of Service" mode) and/or previously invoked "In Service" modes. In some aspects, the machine learning engine 141 may be configured to analyze aggregated player histories, gameplay data, service mode parameters, and/or service mode configurations that are historical or in real-time.

The machine learning engine 141 may build any number of configuration profiles (e.g., player profiles, gaming device 108 profiles) using automatic processing, using artificial intelligence and/or using input from one or more users associated with the communication device 144. The machine learning engine 141 may use automatic processing, artificial intelligence, and/or inputs from one or more users of the communication devices 144 to determine, manage, and/or combine information relevant to a configuration profile.

The machine learning engine 141 may determine configuration profile information based on a user's interactions with information. The machine learning engine 141 may update (e.g., continuously, periodically) configuration profiles based on new information that is relevant. The machine learning engine 141 may receive new information from any communication device 144, the gaming server 116, any database described herein, etc. Profile information may be organized and classified in various manners. In some aspects, the organization and classification of configuration profile information may be determined by automatic processing, by artificial intelligence and/or by one or more users of a communication device 144 (e.g., a player, a floor attendant, a casino manager, etc.).

In an example, the gaming server 116, a gaming device 108 and/or a communication device 144 may provide, to the machine learning engine 141, gameplay data (e.g., quantity of plays, duration of gameplay, credits spent, credits earned, etc.) and/or player information (e.g., player identification information associated with player 112) associated with a gameplay session at the gaming device 108. The machine learning engine 141 may process the gameplay data and/or player information using the data model(s) 142. For example, the machine learning engine 141 may process and determine whether the gameplay data and/or player information satisfies criteria described herein for managing a service mode (e.g., setting parameters associated with an "Out of Service" mode, invoking the "Out of Service" mode, etc.) of the gaming device 108. The machine learning engine 141 may generate an output based on processing the gameplay data.

The output by the machine learning engine 141 may include an indication associated with managing the service mode at the gaming device 108. The indication may include, for example, an indication for setting parameters associated with an "Out of Service" mode, invoking the "Out of Service" mode, invoking a "In Service" mode, etc.

In an example, for a gameplay session associated with a player and the gaming device 108, the machine learning network may generate an output inclusive of probability information and confidence information corresponding to the gameplay session, the player, and user decisions (e.g., invoking a service mode).

In an example, the probability information may include probabilities of whether the player 112 will request to invoke the "Out of Service" mode of the gaming device 108 (e.g., independently by the player 112 via the gaming device 108 and/or the communication device 144). In some aspects, the probability information may indicate a prediction of a temporal instance when the player 112 will request to invoke the "Out of Service" mode. In some cases, the probability information may indicate predictions of user decisions (e.g., user behavior) with respect to the "Out of Service" mode.

For example, the probability information may include a prediction of a "Out of Service" duration (e.g., 10 minutes, 1 hour, overnight) selected by a user (e.g., a player). In an example, the probability information may include predictions of a temporal instance when a player 112 may request to return a gaming device 108 to service (e.g., a user input associated with invoking the "In Service" mode) after the "Out of Service" mode has been invoked. Accordingly, for example, the probability information may include a predicted parameter value(s) (e.g., "In Service" time, "Out of Service" duration) associated with invoking an "Out of Service" mode. In some other cases, the probability information may include predictions of a user input and/or request to extend the "Out of Service" mode.

In some aspects, the gaming server 116 (e.g., the machine learning engine 141) may generate the predictions based on gameplay data such as quantity of plays, gameplay duration, quantity of credits spent, quantity of credits earned, etc. In some examples, the gaming server 116 may generate the predictions based on user behavior away from the gaming device 108 (e.g., user behavior tracked by a member or player tracking system, such as a meal purchase, checking into/out of a hotel room, etc.). The gaming server 116 may generate the predictions using data models 142 and training data 143 described herein.

The probability information described herein may include a probability score (e.g., from 0.00 to 1.00) associated with a predicted parameter value(s). The confidence information described herein may include a confidence score (e.g., from 0.00 to 1.00) corresponding to the probability score(s).

For example, the gaming server 116 (e.g., machine learning engine 141) may determine a probability score based on a correlation between gameplay data associated with a current gameplay session and user behavior associated with a player profile (e.g., as indicated by a data model 142). In some examples, the machine learning engine 141 may output a relatively low probability score for cases in which the machine learning engine 141 identifies a relatively low correlation (e.g., below a threshold) between the gameplay data and the user behavior. In some other examples, the machine learning engine 141 may output a relatively high probability score for cases in which the machine learning engine 141 identifies a relatively high correlation (e.g., above a threshold) between the gameplay data and the user behavior.

The machine learning engine 141 may create, select, and execute appropriate processing decisions. Example processing decisions may include setting parameters (e.g., duration) of an "Out of Service" mode for a gaming device 108, invoking the "Out of Service" mode at the gaming device 108, modifying (e.g., extending) the "Out of Service" mode of the gaming device 108, invoking a "Return to Service" mode of the gaming device 108, and/or transferring the "Out of Service" mode to from the gaming device 108 to another gaming device 108 based on whether gameplay data associated with a gameplay session satisfies the criteria. Other example processing decisions may include notifying a player 112 of information associated with an "Out of Service" mode (e.g., whether the "Out of Service" mode is available to the player 112, whether the "Out of Service" mode has been invoked, ended, and/or transferred, parameters associated with the "Out of Service" mode, etc.). Processing decisions may be handled autonomously and/or semi-autonomously by the machine learning engine 141, with or without human input.

Data within the database of the memory 124 may be updated, revised, edited, or deleted by the machine learning engine 141. In some aspects, the machine learning engine 141 may support continuous, periodic, and/or batch fetching of data (e.g., from gaming devices 108, communication devices 144, databases, servers, etc.) and data aggregation.

Figures 2A, 2B, 2C:
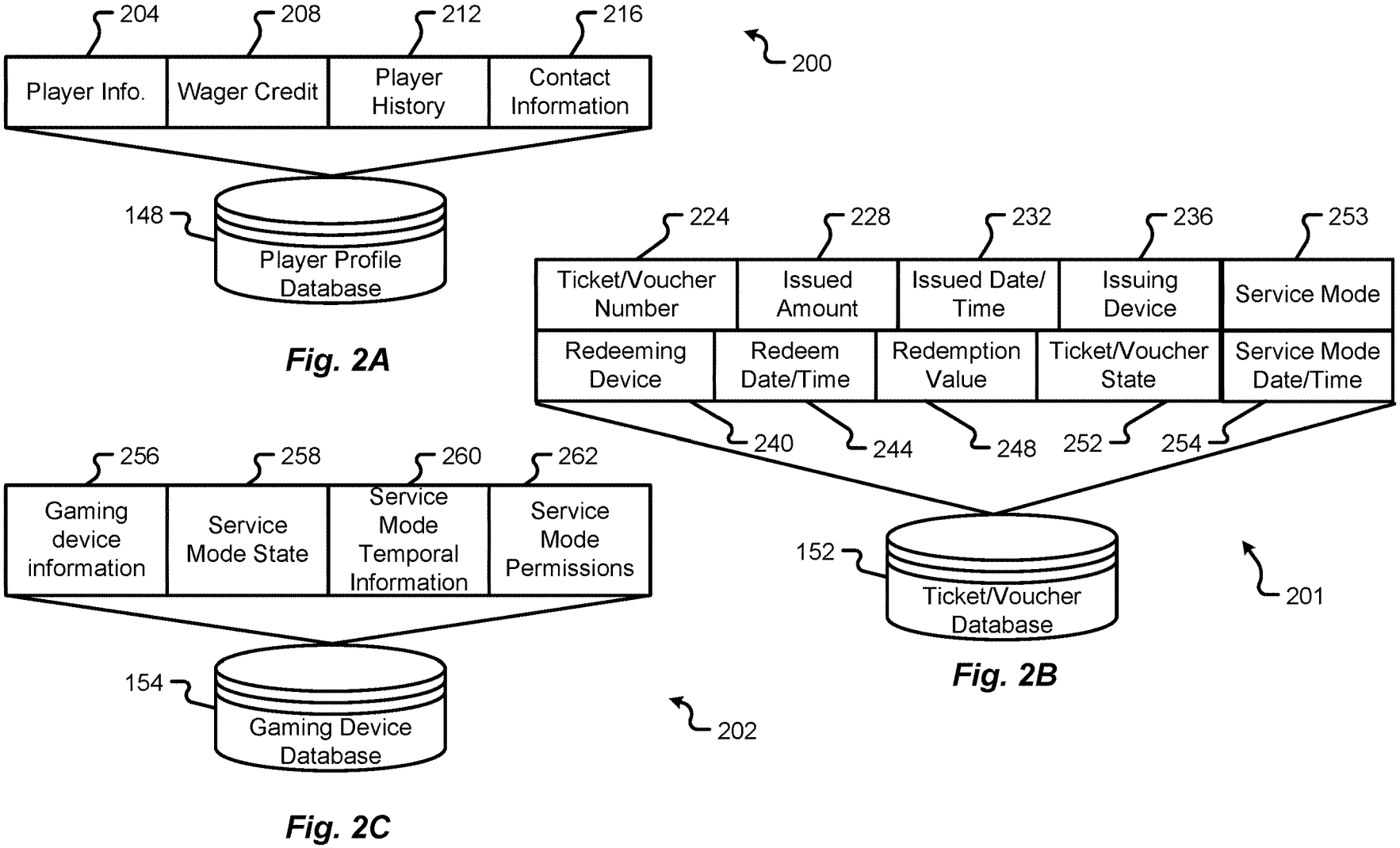
FIG. 2A is a block diagram illustrating a first example data structure used in accordance with aspects of the present disclosure.
FIG. 2B is a block diagram illustrating a second example data structure used in accordance with aspects of the present disclosure.
FIG. 2C is a block diagram illustrating a third example data structure used in accordance with aspects of the present disclosure.

With reference now to FIGS. 2A through 2C, additional details of data structures that are useable in connection with managing a service mode of a gaming device will be described in accordance with at least some embodiments of the present disclosure. It should be appreciated that the data structures depicted and described herein may be stored within a central database or may be distributed among a number of data storage nodes. Alternatively or additionally, some or all of the records of the data structures may be maintained in devices of the gaming system 100 such as the gaming server 116, a gaming device 108, and/or a communication device 144 without departing from the scope of the present disclosure.

With reference initially to FIG. 2A, details of a data structure 200 that may be maintained as part of a player profile will be described in accordance with at least some embodiments of the present disclosure. The database 148 may be configured to store one or multiple data structures 200 that are used in connection with tracking player progress and gaming history. In some embodiments, the data stored in the data structure 200 may be stored for a plurality of different player profiles or for a single player profile. As a non-limiting example, the data structure 200 may be used to store player loyalty information, player history information, and the like. Even more specifically, the data structure 200 may include a plurality of data records that may include, for instance, a player information record 204, a wager credit record 208, a player history record 212, and a contact information record 216.

The player information record 204 may be used to store any type of information that identifies a player or a group of players. In some embodiments, the player information record 204 may store one or more of username information for a player 112, password information for a player account, player status information, accommodations associated with the player 112, and any other type of customer service management data that may be stored with respect to a player 112.

The wager credit record 208 may be used to store data about the available credit of a player 112 with a device, with a sports book, with a casino, and/or with a plurality of casinos. For instance, the wager credit record 208 may store an electronic record of available credit in the player's account and whether any restrictions are associated with such credit. The wager credit record 208 may further store information describing a player's 112 available credit over time, cash out events for the player 112, winning events for the player 112, wagers placed by the player 112, tickets/vouchers issued to the player 112, and the like.

The player history record 212 may be used to store historical data for events that occur with respect to the player 112. For example, the player history record 212 may store information associated with the player 112 in relation to an outcome in a game of chance, an outcome in a game of skill, a celebration event for a person other than the player 112, involvement in a celebration event, visits to a predetermined location, gameplay information with respect to a particular game, player interactions with a communication device 144, wagers placed by the player 112, tickets/vouchers issued for the player 112, tickets/vouchers redeemed by the player 112, etc.

In some other examples, the player history record 212 may store user decisions by the player 112 in relation to instances of setting parameters (e.g., duration) of an "Out of Service" mode for a gaming device 108, invoking the "Out of Service" mode at the gaming device 108, modifying (e.g., extending) the "Out of Service" mode of the gaming device 108, invoking a "In Service" mode of the gaming device 108, and/or transferring the "Out of Service" mode from the gaming device 108 (e.g., gaming device 108-*a*) to another gaming device 108 (e.g., gaming device 108-*b*).

The contact information record 216 may store information associated with a preferred mode(s) of contact for the player 112 and how such contact can be made. For instance, the contact information record 216 may store information such as an email address, phone number, room number, player loyalty number, address, etc.

With reference now to FIG. 2B, details of another data structure 201 that may be used within the gaming system 100 will be described in accordance with at least some embodiments of the present disclosure. The database 152 may be configured to store one or multiple data structures 201 that are used in connection with tracking ticket/voucher status, value, and the like. In some cases, the data structures 201 may be used in connection with tracking credits associated with a gameplay session at a gaming device 108. In some other cases, the data structures 201 may be used in connection with tracking credit transfers between gaming devices (e.g., gaming devices 108 described with reference to FIG. 1) when transferring data associated with an "Out of Service" mode from a gaming device 108 (e.g., gaming device 108-*a*) to another gaming device 108 (e.g., gaming device 108-*b*).

In some embodiments, the data stored in the data structure 201 may be stored for a plurality of different tickets/vouchers and may or may not be organized based on events, player association, etc. As a non-limiting example, the data structure 201 may be used to store ticket/voucher status information, ticket/voucher value information, and the like. The ticket/voucher value information may include credit information associated with a gameplay session at a gaming device 108.

In an example, the data structure 201 may include a plurality of data records that include, for instance, a ticket/voucher number record 224, an issued amount record 228, an issued date/time record 232, an issuing device record 236, a redeeming device record 240, a redeem date/time record 244, a redemption value record 248, and a ticket/voucher state record 252. In some aspects, the data records may include a service mode record 253 and a service mode date/time record 254. It should be appreciated that the data structure 201 may have greater or fewer records than depicted in FIG. 2B.

The ticket/voucher number record 224 may be used to store a unique validation number assigned to the ticket/voucher when a ticket/voucher is issued to a player 112. In some embodiments, the data stored in the ticket/voucher number record 224 may be randomly generated, pseudo-randomly generated, or sequentially generated based on when the ticket/voucher is issued. In some embodiments, the validation number assigned to the ticket/voucher may be unique to the ticket/voucher within the gaming system 100 (e.g., at least unique as to any other ticket/voucher issued within the gaming system 100). While numeric values may be used for the validation number, it should be appreciated that any alphanumeric string may be used for the validation number stored in the ticket/voucher number record 224.

The issued amount record 228 may be used to store an electronic record of a monetary value for which the particular ticket/voucher was issued. The issued amount record 228 may correspond to a data record that is written once and not updated. Thus, even when an associated ticket/voucher transitions from the issued state to another state, the value recorded in the issued amount record 228 may be left unchanged. Likewise, the information stored in the issued date/time record 232 and issuing device record 236 may also be written once and not changed thereafter. The issued date/time record 232 may store information describing when a ticket/voucher is issued, whereas the issuing device record 236 may store information describing where a ticket/voucher is issued. For instance, the issuing device record 236 may indicate a unique serial number assigned to a gaming device 108 that was used to issue the ticket/voucher to the player 112 and the issued date/time record 232 may store the time at which the ticket/voucher was issued by the gaming server 116 and/or the gaming device 108.

In some embodiments, the date/time record 232 may be populated based on a clock of the gaming device 108 that issued the ticket/voucher rather than relying on the clock of the gaming server 116. Said another way, when a gaming device 108 issues a ticket/voucher, such information may be communicated back to the gaming server 116 along with a timestamp provided by the gaming device 108 to indicate a time at which the gaming device 108 issued the ticket/voucher. Using the time indicated by the gaming device 108 can help account for or avoid problems associated with delays in communication over the communication network 104. One such possible problem would be having a wagered event (e.g., a sporting event) come to completion while the communication network 104 is down or unavailable and before the gaming server 116 becomes aware of an issued ticket/voucher by a gaming device 108. Alternatively, or additionally, it may also be possible or desirable to use the clock of the gaming server 116 as the centralized authority on all date/times entered into the record 232, thereby avoiding the need to synchronize or consider synchronization issues between different gaming devices 108.

Like the issuing device record 236, the redeeming device record 240 may be used to store information describing a device at which a ticket/voucher is redeemed by a player 112. Alternatively, or additionally, the redeeming device record 240 may be used to store information describing a communication device 144 via which a player 112 may redeem credits associated with a gameplay session or a player profile. In some embodiments, a device used for redeeming a ticket/voucher or credits may correspond to a gaming device 108 or a communication device 144.

A player 112 may redeem a ticket/voucher at a gaming device 108 by inserting a printed ticket/voucher into a ticket acceptance device of the gaming device 108 (e.g., similar to a bill acceptor). A player 112 may redeem a ticket/voucher at a communication device 144 by scanning the ticket/voucher with a camera of the communication device 144 and transmitting information obtained from the scan of the ticket/voucher back to the gaming server 116 as proof of redemption. Alternatively, or additionally, in the example case of an electronic ticket/voucher (e.g., an e-TITO voucher), a player 112 may to redeem the electronic ticket/voucher at a gaming device 108 or a communication device 144 by using an RFID reader that is in electronic communication with (e.g., electrically coupled to) the gaming device 108 or the communication device 144.

Thus, the redeeming device record 240 may store information uniquely describing the device used by the player 112 to redeem a ticket/voucher (e.g., an address or device ID). Alternatively or additionally, the redeeming device record 240 may store information describing a type of device that was used for redemption (e.g., whether the device is a gaming device 108 or a communication device 144).

The redemption date/time record 244, similar to the issued date/time record 232, may be used to store data and/or time information for the ticket/voucher. For example, the redemption date/time record 244 may be used to store a date/time when a ticket/voucher is redeemed as opposed to when the ticket is issued. Again, the time indicated in the record 244 may be based on a timestamp issued by the redeeming device and/or a clock of the gaming server 116. The date/time provided in the data record 244 may correlate to a date/time when the state of the ticket transitions within the ticket/voucher state record 252.

When the electronic record of the ticket/voucher state 252 is updated, a change to the date/time in record 244 may also be made at substantially the same time. As will be discussed in further detail herein, the ticket/voucher state record 252 may be used to store state or status information for a ticket/voucher and the state within the record 252 may be capable of having at least three different values (e.g., issued, redeemable, and redeemed). Other possible values for the state of the ticket/voucher may include, without limitation, a pending state, which may correspond to a state between the issued state and the redeemable state where a wagered event has come to completion but the redeemable value of the ticket/voucher is still being determined and/or considered.

The redemption value record 248 may be used to store an electronic record indicating an amount for which a ticket/voucher may be redeemed (e.g., a redeemable value) and/or an amount for which a ticket/voucher is actually redeemed (e.g., a redeemed/redemption amount). In embodiments where the redeemable value is the same as the redeemed/redemption value, there may only need to be a single data record 248 to store the redemption value for the ticket/voucher. In some embodiments, it may also be desirable to have separate data records to store a redeemable value for a ticket/voucher and then a redeemed/redemption value for the ticket/voucher. The redeemable value for a ticket/voucher may be determined by the gaming server 116 as soon as the wagered event for which the ticket/voucher is associated has come to completion whereas the redemption value may be determined by the gaming server 116 when the ticket/voucher is redeemed. Again, the redemption value may be the same as or different from the redeemable value without departing from the scope of the present disclosure.

With reference to FIG. 2C, details of a data structure 202 that may be maintained as part of a gaming device profile will be described in accordance with at least some embodiments of the present disclosure. The gaming device database 154 may be configured to store one or multiple data structures 202 that are used in connection with tracking a service mode of a gaming device 108. In some embodiments, the data stored in the data structure 202 may be stored for a plurality of different gaming devices 108 or a single gaming device 108. As a non-limiting example, the data structure 202 may be used to store gaming device information, service mode information, and the like. Even more specifically, the data structure 202 may include a plurality of data records that include, for instance, a gaming device information record 256, a service mode state record 258, a service mode temporal information record 260, and a service mode permissions record 262.

The gaming device information record 256 may be used to store any type of information that identifies a gaming device 108 or a group of gaming devices 108. In some embodiments, the gaming device information record 256 may store identification information for a gaming device 108 (e.g., a unique serial number assigned to the gaming device 108) and any other type of gaming device management data that may be stored with respect to a gaming device 108.

The service mode state record 258 may be used to store any type of information associated with a service mode (e.g., "Out of Service" mode, "Return to Service" mode) of a gaming device 108 or a group of gaming devices 108. In some embodiments, the service mode state record 258 may store information indicating whether a gaming device 108 is in an "Out of Service" mode or a "In Service" mode.

The service mode temporal information record 260 may store date/time information describing when an "Out of Service" mode is invoked at a gaming device 108. In some aspects, the service mode temporal information record 260 may store information describing a duration (e.g., an initially set duration, an extended duration, a remaining duration) associated with the "Out of Service" mode invoked at the gaming device 108. In an example, the service mode temporal information record 260 may store a "Return to Service" time associated with the gaming device 108. In some aspects, the service mode temporal information record 260 may include time periods during which the "Out of Service" mode may be made available to a player.

The service mode permissions record 262 may store permissions information describing whether an "Out of Service" mode may be invoked at a gaming device 108. For example, the service mode permissions record 262 may store permissions information describing whether a player 112 may invoke the "Out of Service" mode at the gaming device 108. In an example, the permissions information may indicate whether invoking the "Out of Service" mode is available to players 112 satisfying a membership status (e.g., player club status) or higher or whether invoking the "Out of Service" mode is regardless of membership status (e.g., available to any player). In another example, the permissions information may indicate whether invoking the "Out of Service" mode is available as a free feature to all players 112 or as a paid feature (e.g., fee-based).

Figure 3:
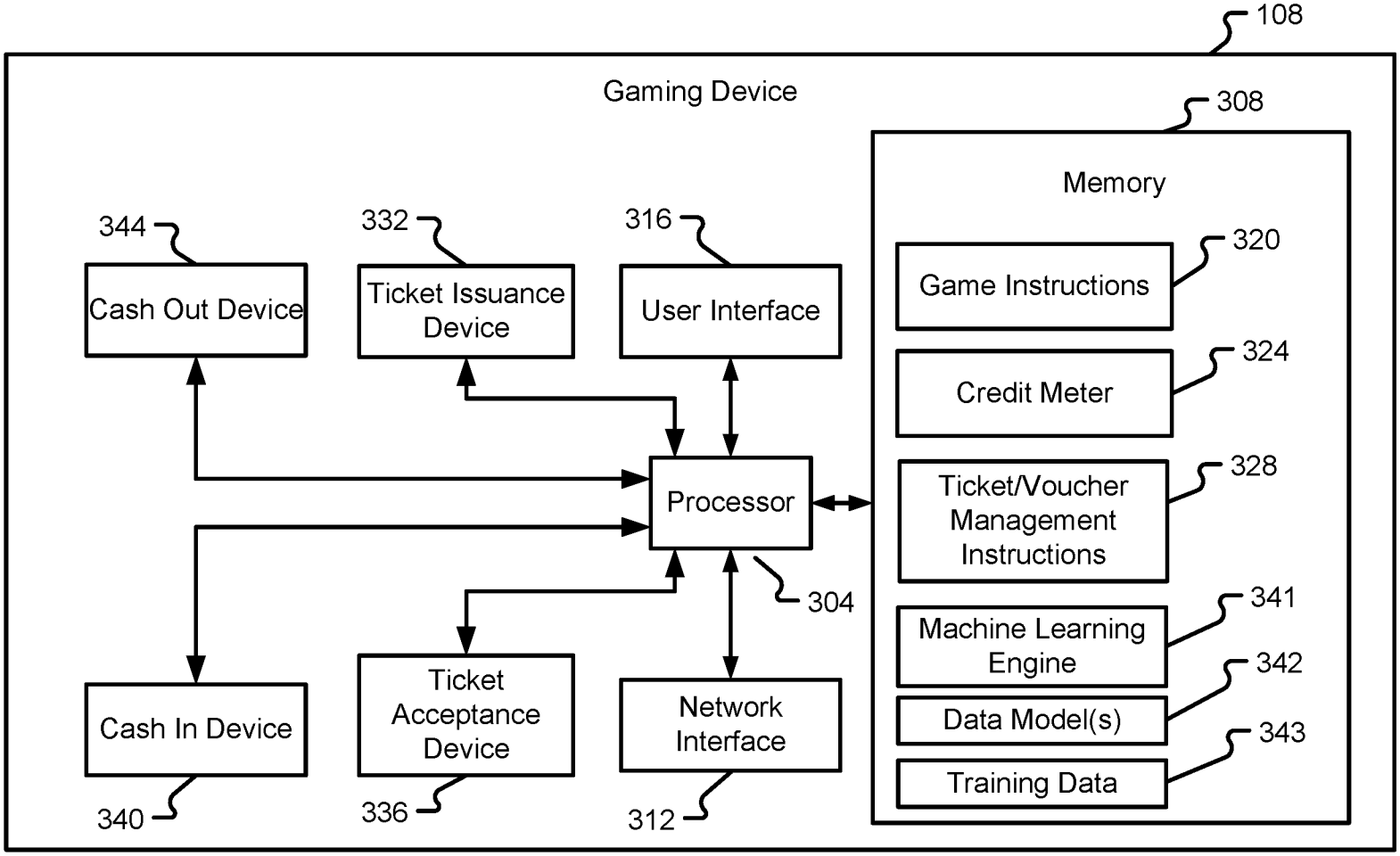
FIG. 3 is a block diagram of a gaming device in accordance with aspects of the present disclosure.

With reference now to FIG. 3, additional details of a gaming device 108 will be described in accordance with at least some embodiments of the present disclosure. While depicted as a gaming device 108, it should be appreciated that some or all of the components of the gaming device 108 may be included in a mobile device 144 described herein without departing from the scope of the present disclosure.

The gaming device 108 is depicted to include a processor 304, memory 308, a network interface 312, a user interface 316, a ticket issuance device 332, a ticket acceptance device 336, a cash-in device 340, and a cash out device 344. In some embodiments, the processor 304 may include example aspects of the processor 120. In other words, the processor 304 may correspond to one or many microprocessors, CPUs, microcontrollers, or the like. The processor 304 may be configured to execute one or more instruction sets stored in memory 308.

The network interface 312 may include example aspects of network interface 128. The nature of the network interface 312, however, may depend upon whether the network interface 312 is provided in a gaming device 108 or a communication device 144. Examples of a network interface 312 include, without limitation, an Ethernet port, a USB port, an RS-232 port, an RS-485 port, a NIC, an antenna, a driver circuit, a modulator/demodulator, etc. The network interface 312 may include one or multiple different network interfaces depending upon whether the gaming device 108 is connecting to a single communication network 104 or multiple different types of communication networks 104. For instance, the gaming device 108 may be provided with both a wired network interface and a wireless network interface without departing from the scope of the present disclosure.

The user interface 316 may correspond to any type of input and/or output device that enables the player 112 to interact with the gaming device 108. As can be appreciated, the nature of the user interface 316 may depend upon the nature of the gaming device 108. For instance, if the gaming device 108 is a traditional mechanical reel slot machine, then the user interface 316 may include one or more mechanical reels with symbols provided thereon, one or more lights or LED displays, one or more depressible buttons, a lever or "one armed bandit handle", a speaker, or combinations thereof. If the gaming device 108 is a digital device, then the user interface 316 may include one or more touch-sensitive displays, LED/LCD display screens, etc. In some cases, the user interface 316 may include a combination of a physical interface (e.g., mechanical reels, depressible buttons, a lever, etc.) and other user interfaces (e.g., touch-sensitive displays, LED/LCD display screens, etc.). In some cases, the user interface 316 may include a biometric scanning device (e.g., a fingerprint scanner) supportive of biometric inputs by a user.

The memory 308 may include example aspects of memory 124. For instance, the memory 308 may include one or multiple computer memory devices that are volatile or non-volatile. The memory 308 may be configured to store instruction sets that enable player interaction with the gaming device 108, that enable game play at the gaming device 108, and/or that enable coordination with the gaming server 116. Examples of instruction sets that may be stored in the memory 308 include a game instruction set 320, a credit meter 324, and a ticket/voucher management instruction set 328.

In some embodiments, the game instruction set 320, when executed by the processor 304, may enable the gaming device 108 to facilitate one or more games of chance or skill and produce interactions between the player 112 and the game of chance or skill. In some embodiments, the game instruction set 320 may include subroutines that present one or more graphics to the player 112 via the user interface 316, subroutines that calculate whether a particular wager has resulted in a win or loss during the game of chance or skill, subroutines for determining payouts for the player 112 in the event of a win, subroutines for exchanging communications with a connected server (e.g., game management server, gaming server 116, or the like), subroutines for enabling the player 112 to engage in a game using their mobile user device 144, and any other subroutine or set of instructions that facilitate gameplay at or in association with the gaming device 108.

In some aspects, the game instruction set 320, when executed by the processor 304, may enable the gaming device 108 to facilitate interactions between the player 112 or another user (e.g., a floor attendant) in association with invoking an "Out of Service" mode of the gaming device 108. In an example, the game instruction set 320 may include subroutines that present, via the user interface 316, a menu or notifications associated with aspects described herein for setting and/or viewing parameters (e.g., duration) of an "Out of Service" mode for a gaming device 108, invoking the "Out of Service" mode at the gaming device 108, modifying (e.g., extending) the "Out of Service" mode of the gaming device 108, invoking a "Return to Service" mode of the gaming device 108, and/or transferring the "Out of Service" mode to from the gaming device 108 to another gaming device 108. In some examples, the game instruction set 320 may include subroutines that present the menu or notifications via a communication device 144.

The credit meter 324 may correspond to a secure instruction set and/or data structure within the gaming device 108 that facilitates a tracking of activity at the gaming device 108. In some embodiments, the credit meter 324 may be used to store or log information related to various activities of a player 112 and events that occur at the gaming device 108. The types of information that may be maintained in the credit meter 324 include, without limitation, player information, available credit information, wager amount information, and other types of information that may or may not need to be recorded for purposes of accounting for wagers placed at the gaming device 108 and payouts made for a player 112 during a game of chance or skill played at the gaming device 108.

In some embodiments, the credit meter 324 may be configured to track credit (e.g., coin) in activity, credit (e.g., coin) out activity, credit (e.g., coin) drop activity, jackpot paid activity, bonus paid activity, credits applied activity, external bonus payout activity, ticket/voucher in activity, ticket/voucher out activity, timing of events that occur at the gaming device 108, and the like. In some embodiments, certain portions of the credit meter 324 may be updated in response to outcomes of a game of chance or skill played at the gaming device 108. In some embodiments, the credit meter 324 may be updated depending upon whether the gaming device 108 is issuing a ticket/voucher, being used as a point of redemption for a ticket/voucher, and/or any other activity associated with a ticket/voucher. Some or all of the data within the credit meter 324 may be reported to the gaming server 116, for example, if such data applies to a centrally-managed game and/or a status of a ticket/voucher. As an example, the number, value, and timing of wagers placed by a particular player 112 and payouts on such wagers may be reported to the gaming server 116.

In an example, the credit meter 324 may support the transfer of credits between the gaming device 108 and another gaming device 108. For example, the credit meter 324 may support the transfer of credits from a first gaming device 108 (e.g., gaming device 108-*a*) to a second gaming device 108 (e.g., gaming device 108-*b*) when transferring an "Out of Service" mode to the second gaming device 108 (e.g., gaming device 108-*b*) from the first gaming device 108 (e.g., gaming device 108-*a*). The transfer of the "Out of Service" mode may be triggered, for example, based on the insertion of a ticket/voucher associated with the "Out of Service" mode into the second gaming device 108 (e.g., gaming device 108-*b*). In another example, the transfer of the "Out of Service" mode may be triggered based on a "card in" event (e.g., using a communication device 144) at the second gaming device 108 (e.g., gaming device 108-*b*). In some other examples, the transfer of the "Out of Service" mode may be triggered based on the entry of an access code (e.g., at the second gaming device 108 (e.g., gaming device 108-*b*), at the first gaming device 108 (e.g., gaming device 108-*a*), at a communication device 144, etc.) associated with transferring the "Out of Service" mode from the first gaming device 108 (e.g., gaming device 108-*a*) to the second gaming device 108 (e.g., gaming device 108-*b*).

The respective credit meters 324 at the first gaming device 108 (e.g., gaming device 108-*a*) and the second gaming device 108 (e.g., gaming device 108-*b*) may be updated in response to the credit transfer and/or the transfer of the "Out of Service" mode. In some cases, the credit amounts at the respective credit meters 324 may be updated (e.g., by the gaming device 108, the gaming server 116, and/or the communication device 144) at the ticket/voucher database 152.

Activities of the gaming device 108 related to ticket/voucher activity may be managed and reported by the ticket/voucher management instruction set 328. In some embodiments, when a ticket/voucher is redeemed at the gaming device 108 by the player 112, information associated with the ticket/voucher may be obtained by the ticket/voucher management instruction set 328 and reported to the gaming server 116. Furthermore, the ticket/voucher management instruction set 328 may be configured to update the credit meter 324 if the redeemed ticket/voucher is determined to be in a redeemable state and has a redeemable or redemption value associated therewith. In some embodiments, the credit meter 324 may be updated or incremented by the redeemable or redemption value of the ticket/voucher when redeemed. This information may be obtained directly from the ticket/voucher or may include some interactions (e.g., verification operations) with the gaming server 116 prior to updating the credit meter 324.

The gaming device 108 may be provided with appropriate hardware to facilitate acceptance and issuance of tickets/vouchers. Specifically, the gaming device 108 may be provided with a ticket acceptance device 336 that is configured to accept or scan physically-printed tickets/vouchers and extract appropriate information therefrom. In some embodiments, the ticket acceptance device 336 may include one or more machine vision devices (e.g., a camera, IR scanner, optical scanner, barcode scanner, etc.), a non-visual scanning device (e.g., an RFID reader, an NFC reader), a physical ticket acceptor, a shredder, etc. The ticket acceptance device 336 may be configured to accept physical tickets and/or electronic tickets without departing from the scope of the present disclosure. An electronic ticket/voucher may be accepted by scanning a visual code (e.g., a one-dimensional barcode, a two-dimensional barcode, any other type of barcode, a quick response (QR) code, etc.) displayed on a printed ticket/voucher or a communication device 144, for example. In another example, an electronic ticket/voucher may be accepted by scanning a tag (e.g., an RFID tag, an NFC tag, a contactless smart card, or the like) storing the ticket/voucher information.

The ticket issuance device 332 may be configured to print or provide physical tickets/vouchers to players 112. In some embodiments, the ticket issuance device 332 may be configured to issue a ticket/voucher consistent with an amount of credit available to a player 112, possibly as indicated within the credit meter 324. In some cases, the ticket/voucher may be an e-TITO voucher including a reprogrammable electronic display and an RFID tag. In some aspects, for cases in which an "Out of Service" mode has been invoked at a gaming device 108 in association with a gameplay session, the gaming device 108 may issue a corresponding e-TITO voucher. In an example, the e-TITO voucher may include printed information and/or electronically displayed information indicating data associated with the gameplay session and the "Out of Service" mode. The data associated with the gameplay session and the "Out of Service" mode may include, for example, available credits, an "Out of Service" duration, a countdown timer, identification information of the gaming device 108, or the like.

The cash-in device 340 may include a bill acceptor, a coin acceptor, a chip acceptor or reader, or the like. In some embodiments, the cash-in device 340 may also include credit card reader hardware and/or software. In some aspects, the cash-in device 340 may include one or more machine vision devices (e.g., a camera, IR scanner, optical scanner, barcode scanner, etc.) or non-visual scanning devices (e.g., an RFID reader/writer, an NFC reader/writer).

The cash-out device 344, like the ticket issuance device 322, may operate and issue cash, coins, tokens, or chips based on an amount indicated within the credit meter 324. In some embodiments, the cash-out device 344 may include a coin tray or the like and counting hardware configured to count and distribute an appropriate amount of coins or tokens based on a player's 112 winnings or available credit within the credit meter 324. In some aspects, the cash-out device 344 may include one or more machine vision devices or non-visual scanning devices.

The memory 308 may be configured to store instruction sets, neural networks, and other data structures (e.g., depicted herein) in addition to temporarily storing data for the processor 304 to execute various types of routines or functions. For example, the memory 308 may be configured to store program instructions (instruction sets) that are executable by the processor 304 and provide functionality of a machine learning engine 341 described herein. The machine learning engine 341 may include example aspects of the machine learning engine 141 described with reference to FIG. 1.

One example of data that may be stored in memory 308 for use by components thereof is a data model(s) 342 and/or training data 343. The data model(s) 342 and the training data 343 may include examples of aspects of the data model(s) 142 and the training data 143 described with reference to the gaming server 116. The gaming device 108 (e.g., the machine learning engine 341) may utilize one or more data models 342 for recognizing and processing information obtained by the gaming device 108, another gaming device 108, a server (e.g., the gaming server 116), communication devices 144, and/or a database (e.g., player profile database 148, ticket/voucher database 152, and/or gaming device database 154). In some aspects, the gaming device 108 (e.g., the machine learning engine 341) may update one or more data models 342 based on learned information included in the training data 343.

In some aspects, components of the machine learning engine 341 may be provided in a separate machine learning engine (e.g., at server, for example, the gaming server 116) in communication with the gaming device 108.

Figure 4:
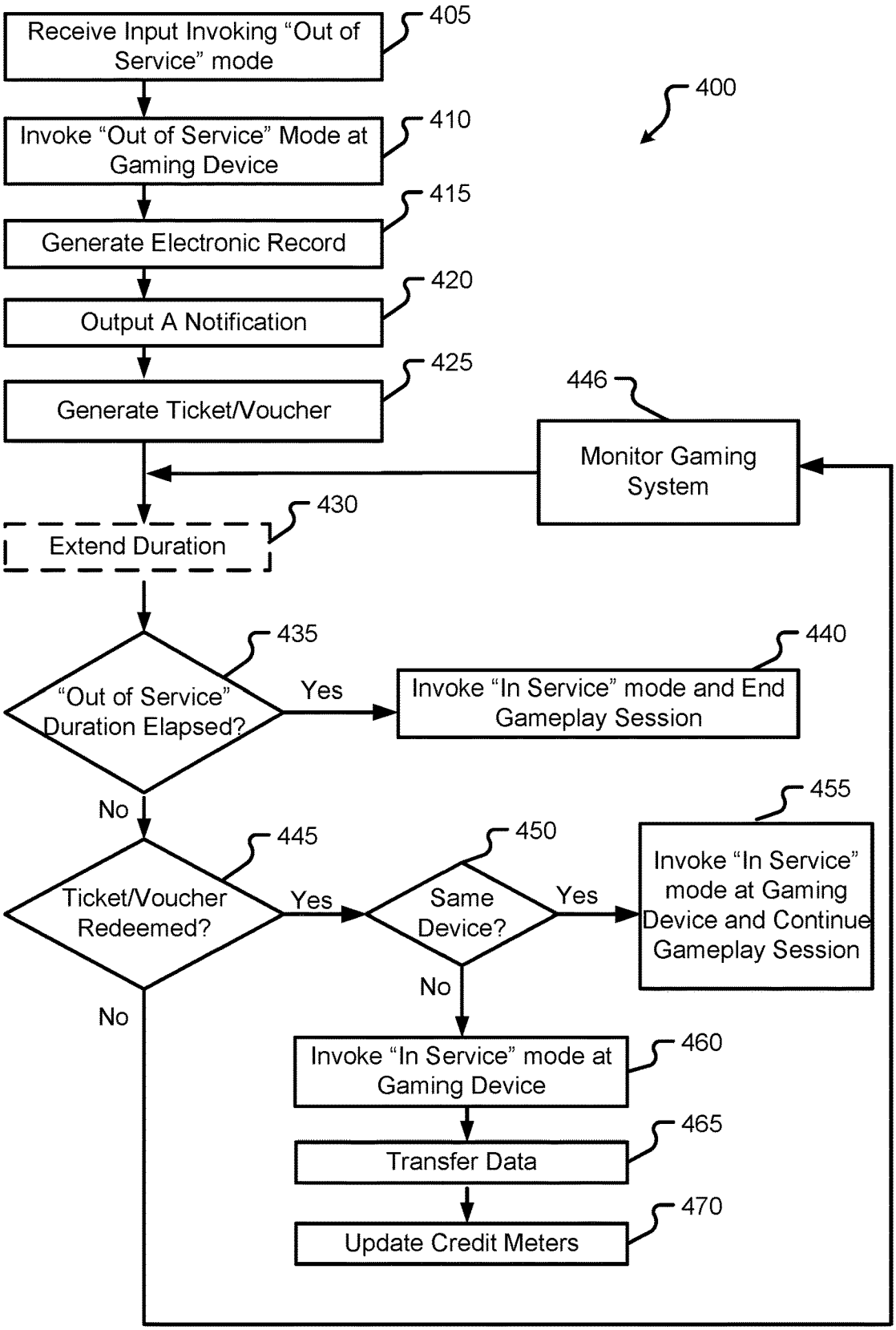
FIG. 4 is a process flow illustrating managing service modes of a gaming device in accordance with aspects of the present disclosure.

FIG. 4 illustrates an example of a process flow 400 that supports aspects of the present disclosure associated with taking a gaming device out of service (e.g., invoking the "Out of Service" mode), with or without intervention from a floor attendant. The process flow 400 supports aspects of the present disclosure associated with returning the gaming device to service (e.g., invoking the "In Service" mode), without intervention from a floor attendant. In some examples, process flow 400 may implement aspects of gaming system 100. Further, process flow 400 may be implemented by a gaming system 100 or components included therein as described with reference to FIGS. 1 through 3.

In the following description of the process flow 400, the operations may be performed in a different order than the order shown, or the operations may be performed in different orders or at different times. Certain operations may also be left out of the process flow 400, or other operations may be added to the process flow 400. It is to be understood that any device (e.g., a gaming device 108, a gaming server 116, a communication device 144, components of the system 100, etc.) may perform the operations shown.

At 405, during a gameplay session at a gaming device 108, the gaming server 116 may receive a user input that invokes an "Out of Service" mode for the gaming device 108. In some aspects, the user input may include a parameter value (e.g., "Out of Service" duration) associated with the "Out of Service" mode.

In an example, the gaming device 108 may receive the user input via a user interface of the gaming device 108 (e.g., user interface 316 described with reference to FIG. 3), and the gaming device 108 may communicate data associated with the user input to the gaming server 116. In another example, a communication device 144 in communication with the gaming device 108 may receive the user input via a user interface (e.g., a mobile application, a menu, a physical interface) of the communication device 144, and the communication device 144 may communicate data associated with the user input to the gaming server 116. In some cases, the user input may be entered by a floor attendant (e.g., a casino employee). In some other cases, the user input may be entered by a player 112 (e.g., without intervention by the floor attendant).

In some aspects, the gaming server 116 may make the "Out of Service" mode available for the player 112 (e.g., enable selection of the "Out of Service" mode) based whether gameplay data (e.g., quantity of plays, duration of continuous gameplay) associated with the gameplay session satisfies a set of criteria. In some other aspects, the gaming server 116 may make the "Out of Service" mode available for the player 112 based whether player information (e.g., membership status, player club status) of the player satisfies a set of criteria.

In some aspects, the gaming server 116 may support multiple types of "Out of Service" modes for a gaming device 108. For example, the gaming server 116 may support player initiated "Out of Service" modes at a gaming device 108. In some aspects, the gaming server 116 may support setting a temporal duration (e.g., a timer, a time limit, an "Out of Service" duration, etc.) associated with player initiated "Out of Service" modes.

In another example, the gaming server 116 may support administrator (e.g., floor attendant, casino operator, etc.) initiated "Out of Service" modes at a gaming device 108. In some aspects, the gaming server 116 may support refraining from setting a temporal duration (e.g., a timer, a time limit, etc.) associated with administrator initiated "Out of Service" modes. For example, the gaming server 116 may support administrator initiated "Out of Service" modes, without setting a corresponding temporal duration (e.g., without setting an "Out of Service" duration). Accordingly, for example, the gaming server 116 may support administrator initiated "Out of Service" modes having no time limit.

For example, the gaming server 116 may enable selection of the "Out of Service" mode based on a comparison of the quantity of plays to a threshold quantity and/or a comparison of the duration of continuous play to a threshold duration. In some aspects, the gaming server 116 may enable the option associated with invoking the "Out of Service" mode based on a comparison of the membership status to a target membership status (e.g., a membership level). In some other aspects, the gaming server 116 may enable the option associated with invoking the "Out of Service" mode if the player pays an associated fee associated with invoking the "Out of Service" mode.

At 410, based on the user input, the gaming device 108 may be placed into the "Out of Service" mode. For example, the gaming server 116 may communicate data to the gaming device 108 that invokes the "Out of Service" mode at the gaming device 108.

In an example, the gaming server 116 may invoke the "Out of Service" mode at the gaming device 108 (e.g., place the gaming device 108 into the "Out of Service" mode) according to an "Out of Service" duration indicated in the user input.

At 415, the gaming server 116 may generate an electronic record based on invoking the "Out of Service" mode. The electronic record may include parameters described herein in association with the "Out of Service" mode. In an example, the parameters may include a "Return to Service" time, an "Out of Service" duration, remaining gameplay credits, identification information of the gaming device 108, or the like.

At 420, the gaming server 116 may output a notification including at least a portion of the electronic record. In an example, the gaming server 116 may transmit the notification to the gaming device 108, and the gaming device 108 may output the notification via the user interface of the gaming device 108. In another example, the gaming server 116 may transmit the notification to the communication device 144, and the communication device 144 may output the notification via the user interface of the communication device 144.

At 425, the gaming device 108 may generate a ticket/voucher associated with the "Out of Service" mode. In an example, the ticket/voucher may include printed information (e.g., a barcode, text information) describing at least some of the parameters associated with the "Out of Service" mode. In some examples, the ticket/voucher may be an electronic ticket (e.g., an e-TITO voucher) including an electronic display on which at least some the parameters associated with the "Out of Service" mode are displayed.

Alternatively, or additionally, at 425, the communication device 144 may generate (e.g., via a mobile application) a virtual ticket associated with the "Out of Service" mode. The virtual ticket may include the same or different information as the ticket/voucher generated by the gaming device 108. In some cases, the gaming server 116 may generate and transmit data associated with the virtual ticket to the communication device 144, and the communication device 144 may store and/or display the virtual ticket. In an example, the virtual ticket may be redeemable at the gaming device 108, for example, via a machine vision device (e.g., a camera, IR scanner, optical scanner, barcode scanner, etc.) or a non-visual scanning device (e.g., an RFID reader, an NFC reader) at the gaming device 108.

In some cases, at 430, the gaming server 116 may receive a user input (e.g., by the player 112, a casino operator, a restaurant employee, etc.) for extending the "Out of Service" mode. In some aspects, the gaming server 116 may enable extensions of the "Out of Service" mode based on whether a set of criteria is met (e.g., a player status level, a paid fee, etc.). In some aspects, the user input for extending the "Out of Service" mode may be entered at the gaming device 108, the communication device 144 of the player 112, or a communication device 144 of another user (e.g., casino operator, restaurant employee, etc.). For example, the gaming server 116 and the communication devices 144 may support a casino rewards application that provides access to player statuses, and a user (e.g., player 112, casino operator, restaurant employee, etc.) may extend the "Out of Service" mode via the casino rewards application. In some other aspects, the gaming server 116 may automatically extend the "Out of Service" mode based on a set of criteria (e.g., player preferences, a player status level, a paid fee, etc.) when the remaining time associated with the "Out of Service" mode is less than a temporal value.

At 435, the gaming server 116 may identify that the "Out of Service" duration has elapsed. For example, the gaming server 116 may identify that the player has failed to resume the gameplay session at the gaming device 108 prior to the end of the "Out of Service" duration. In an example, the gaming server 116 may detect that the player has failed to redeem the electronic ticket at the gaming device 108, failed to redeem the virtual ticket at the gaming device 108, failed to enter a user input (e.g., an access code, a user selection) at the gaming device 108 in association with resuming the gameplay session, and/or failed to enter a user input (e.g., an access code, a user selection) at the communication device 144 in association with resuming the gameplay session.

At 440, the gaming server 116 may automatically invoke the "In Service" mode of the gaming device 108 and unlock the gaming device 108 for use by any player 112. In some aspects, invoking the "In Service" mode at 440 may include ending the gameplay session and resetting the credit meter at the gaming device 108.

At 445, the gaming server 116 may detect a user input associated with redeeming the ticket/voucher (or the virtual ticket). In an example, the user input may include the redemption of the electronic ticket at a gaming device 108 (e.g., the gaming device 108 held in the "Out of Service" mode, a different gaming device 108) or a non-gaming device (e.g., a cashier station). In another example, the user input may include the redemption of the virtual ticket (stored on the communication device 144) at the gaming device 108 or the non-gaming device. In another example, the user input may include a user input (e.g., an access code, a biometric input, a user selection) at a user interface of the gaming device 108.

In another example, the user input at 445 may include a user input (e.g., an access code, a biometric input, a user selection) at a communication device 144 in electronic communication with the gaming device 108 and/or gaming server 116. Such a user input, for example, may include a user selection to cancel the "Out of Service" mode (e.g., remove the hold) associated with the gaming device 108.

Aspects of the process flow 400 may include continuous monitoring (e.g., at 446) of the gaming system 100. In some aspects, the monitoring may be implemented at the gaming server 116. In some other aspects, the monitoring may be implemented by tracking system separate from the gaming server 116, and the tracking system may report results of monitoring the gaming system 100 to the gaming server 116.

At 450, the gaming server 116 may identify whether the user input at 445 is provided at the gaming device 108 held in the "Out of Service" mode or a different device (e.g., another gaming device 108, a cashier station).

For example, at 450, the gaming server 116 may identify that the user input (e.g., ticket/voucher redemption) was provided at the gaming device 108 held in the "Out of Service" mode. At 455, the gaming server 116 may invoke the "Return to Service" mode at the gaming device 108 and maintain the gameplay session at the gaming device 108. The gaming server 116 and/or gaming device 108 may resume the gameplay session at the gaming device 108.

In an example, the gaming device 108 may relay data (e.g., ticket/voucher information, virtual ticket information, access code, identification information of the gaming device 108) associated with the user input to the gaming server 116, and the gaming server 116 may place the gaming device 108 into the "In Service" mode in association with the gameplay session.

Alternatively, or additionally, at 450, the gaming server 116 may identify that the user input (e.g., ticket/voucher redemption) was not provided at the gaming device 108 held in the "Out of Service" mode. For example, the gaming server 116 may identify that the user input (e.g., ticket/voucher redemption) was provided at another gaming device 108. In another example, the gaming server 116 may identify that the user input (e.g., ticket/voucher redemption) was provided at a cashier station.

At 460, the gaming server 116 may invoke the "In Service" mode at the gaming device 108. For example, at 460, the gaming server 116 may invoke the "In Service" mode of the gaming device 108 and unlock the gaming device 108 for use by any player 112, without maintaining the gameplay session at the gaming device 108.

At 465, for cases in which the user input (e.g., ticket/voucher redemption) of 445 was provided at another gaming device 108 of the same type as the gaming device 108 held in the "Out of Service" mode, the gaming server 116 may transfer data associated with the "Out of Service" service mode to the other gaming device 108.

In some aspects, transferring data associated with the "Out of Service" mode may include transferring the gameplay session from the gaming device 108 to the other gaming device 108. In an example, the gaming server 116 may transfer data associated with the gameplay session (e.g., credits played, credits won, available credits, previous gameplay result, current gameplay settings, etc.) to the other gaming device 108. In some examples, the gaming server 116 may end the gameplay session at the gaming device 108 but transfer, to the other gaming device 108, the available credits associated with the gameplay session.

In another example, at 465, for cases in which the user input (e.g., ticket/voucher redemption) of 445 was provided at another gaming device 108 of a different type as the gaming device 108 held in the "Out of Service" mode, the gaming server 116 may transfer available credits from the gaming device 108 to the other gaming device 108.

In some aspects, at 465, transferring data may include transferring parameter values of the "Out of Service" mode to the other gaming device 108. For example, the gaming server 116 may transfer the "Out of Service" mode to the other gaming device 108 (e.g., hold the other gaming device 108 in the "Out of Service" mode for the player 112). In some aspects, when transferring the "Out of Service" mode, the gaming server 116 may allocate the remaining duration of the transferred "Out of Service" mode to the other gaming device 108. In some other aspects, at 465, when transferring the "Out of Service" mode to the other gaming device 108, the gaming server 116 may allocate a new "Out of Service" duration for the other gaming device 108 (e.g., resetting the "Out of Service" duration). In some aspects, allocating the new "Out of Service" duration may be fee-based or based on a membership status.

At 470, the gaming server 116 may update the respective credit meters at the gaming device 108 and the other gaming device 108. For example, the gaming server 116 may transfer the gameplay credits associated with the gameplay session from the gaming device 108 (e.g., gaming device 108-*a*) previously held in the "Out of Service" mode, to the other gaming device 108 (e.g., gaming device 108-*b*).

In an example, for cases in which the user input (e.g., ticket/voucher redemption) of 445 was provided at another gaming device 108 of the same type as the gaming device 108 (e.g., gaming device 108-*a*) held in the "Out of Service" mode, the gaming server 116 may resume the same gaming session at the other gaming device 108 (e.g., gaming device 108-*b*).

According to example aspects of the present disclosure, the gaming server 116, the gaming devices 108, and/or the communication device 144 may store any of the data associated with the process flow 400 to a database described herein and/or a memory (e.g., training data 143).

Figure 5:
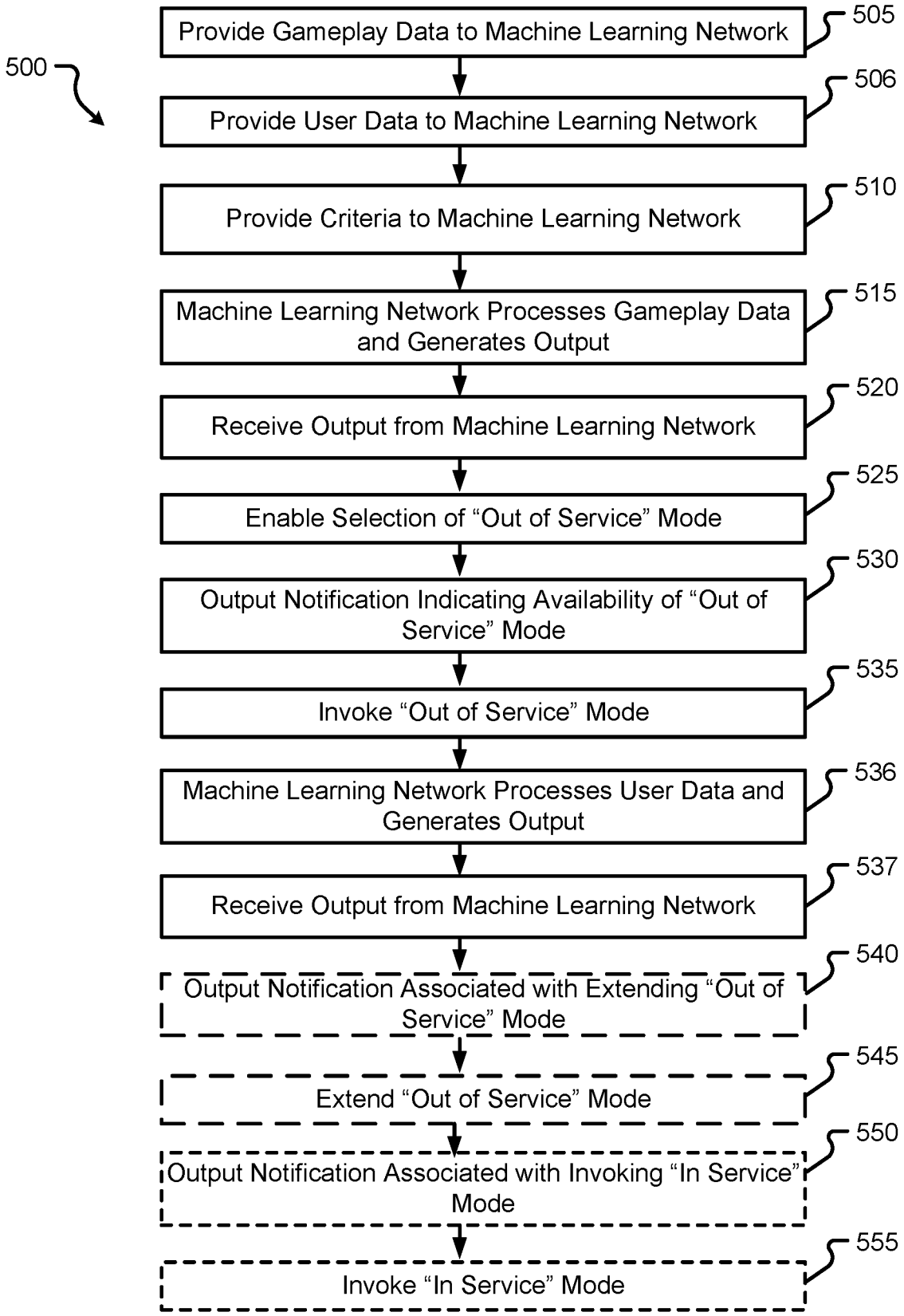
FIG. 5 is a process flow illustrating autonomously or semi-autonomously managing service modes of a gaming device, based on an output by a machine learning network included in the gaming system, in accordance with aspects of the present disclosure.

FIG. 5 illustrates an example of a process flow 500 that supports aspects of the present disclosure associated with autonomously and/or semi-autonomously managing the "Out of Service" mode and "Return to Service" mode of a gaming device 108 (e.g., with partial or no intervention from a player) based on an analysis of gameplay data by a machine learning network included in the gaming system 100.

For example, the process flow 500 supports aspects of the present disclosure associated with autonomously taking a gaming device 108 out of service (e.g., without intervention from a player) and/or semi-autonomously taking a gaming device 108 out of service (e.g., with partial intervention from a player). The process flow 500 further supports aspects of the present disclosure associated with autonomously returning the gaming device 108 to service (e.g., without intervention from a player 112) and/or semi-autonomously returning the gaming device 108 to service (e.g., with partial intervention from a player 112).

In some examples, process flow 500 may implement aspects of gaming system 100. Further, process flow 500 may be implemented by a gaming system 100 or components included therein as described with reference to FIGS. 1 through 3.

Machine learning techniques described herein with reference to the process flow 500 may be implemented with respect to aspects of the present disclosure in association with managing service modes of a gaming device 108. For example, the machine learning techniques of process flow 500 may be implemented at any portions of the process flow 400 described with reference to FIG. 4.

In the following description of the process flow 500, the operations may be performed in a different order than the order shown, or the operations may be performed in different orders or at different times. Certain operations may also be left out of the process flow 500, or other operations may be added to the process flow 500. It is to be understood that any device (e.g., a gaming device 108, a gaming server 116, a communication device 144, components of the system 100, etc.) may perform the operations shown.

At 505, the gaming server 116 may provide, to a machine learning network (e.g., a machine learning engine 141 at the gaming server 116), gameplay data corresponding to a gameplay session at a gaming device 108. In some other aspects, the gaming device 108 and/or the communication device 144 may provide the gameplay data to the machine learning network. In an example, the gameplay data may include data such as player 112 information (e.g., player membership status, a player history, etc.), quantity of plays, duration of gameplay, credits spent, credits earned, etc.

At 506, the gaming server 116 may provide user data to the machine learning network. In some aspects, the user data may include previous user decisions (e.g., user behavior) with respect to invoking an "Out of Service" mode (e.g., as in 405 of the process flow 400), modifying an invoked "Out of Service" mode (e.g., as in 430 of the process flow 400), and/or invoking a "In Service" mode (e.g., as in 455 or 460 of the process flow 400). In some other aspects, the user data may include player behavior (e.g., player behavior tracked by a member or player tracking system, such as a meal purchase, checking into/out of a hotel room, etc.) away from the gaming device 108 in association with previous instances in which the "Out of Service" mode is invoked at the gaming device 108. In some cases, the user data may include player behavior (e.g., player behavior tracked by a member or player tracking system, such as a meal purchase, checking into/out of a hotel room, etc.) away from the gaming device 108 in association with a current instance in which the "Out of Service" mode is invoked at the gaming device 108.

In some aspects, the gaming server 116 may continuously or periodically (e.g., based on a temporal interval) provide the gameplay data and/or the user data to the machine learning network. For example, the gaming server 116 may provide the gameplay data and/or the user data to the machine learning network at any portion of the process flow 500.

At 510, the gaming server 116 may provide, to the machine learning network, a set of criteria associated with managing service modes (e.g., an "Out of Service" mode, a "In Service" mode) of the gaming device 108. In an example, the set of criteria may be indicative of player behavior associated with managing service modes of a gaming device 108.

At 515, the machine learning network (e.g., machine learning engine 341) may process the gameplay data and/or the user data. In some aspects, in processing the gameplay data, the machine learning network may determine whether the gameplay data satisfies the set of criteria. The machine learning network may generate an output in response to the machine learning network processing the data with respect to the set of criteria. In some aspects, the machine learning network may continuously or periodically process the gameplay data and/or the user data (e.g., based on a temporal interval, based on receiving updated data, etc.). In some cases, the machine learning network may continuously or periodically generate outputs based on the gameplay data and/or user data (e.g., based on a temporal interval, based on newly processed data, etc.).

The output from the machine learning network may include an indication associated with managing a service mode at the gaming device 108. For example, the output may include a predicted value(s) of parameters (e.g., "In Service" time, "Out of Service" duration) associated with invoking an "Out of Service" mode at the gaming device 108. In some cases, the output may include predicted user decisions (e.g., player behavior, behavior of a casino operator, a floor attendant, a restaurant employee, etc.) with respect to invoking an "Out of Service" mode (e.g., as in 405 of the process flow 400), modifying an invoked "Out of Service" mode (e.g., as in 430 of the process flow 400), and/or invoking a "In Service" mode (e.g., as in 440, 455, or 460 of the process flow 400).

In an example, the machine learning network may process the gameplay data using a data model (e.g., data model 142 described with reference to FIG. 1). The training data may include example aspects of the training data 143 described with reference to FIG. 1 (e.g., player decisions, player behavior, gameplay history, etc.). For example, the training data may be associated with previous instances of invoking an "Out of Service" mode at a gaming device 108, extending a duration associated with the "Out of Service" mode, invoking a "In Service" mode at a gaming device 108, or the like.

Example aspects of invoking an "Out of Service" mode, extending a duration associated with the "Out of Service" mode, and invoking a "In Service" mode at a gaming device 108, are described with reference to 520 through 555 of the process flow 500.

At 520, in an example case of a gaming device 108 for which the "Out of Service" mode is not invoked with respect to an existing gameplay session, the gaming server 116 may receive an output (e.g., predicted value(s) of parameters, predicted user decisions, etc.) from the machine learning network.

The output may include a probability score and/or confidence score that the player 112 will request a hold (e.g., invoke the "Out of Service" mode) within a predicted quantity of plays, within a predicted temporal duration, or the like. In another example, the output may include a probability score and/or confidence score that the player 112 will request a hold after a loss amount (e.g., a net quantity of credits lost) exceeds a threshold, after a win amount (e.g., a net quantity of credits earned) exceeds a threshold, or the like. In some other examples, the output may include a probability score and/or confidence score that the player will request a hold after a consecutive quantity of winning bets exceeds a threshold, a consecutive quantity of losing bets exceeds a threshold, or the like.

In some aspects, for the example case in which the "Out of Service" mode is invoked, the output by the machine learning network (e.g., machine learning engine 141) may include a probability score and/or confidence score associated with a prediction of when the player 112 will release the hold on the gaming device 108. For example, the output by the machine learning network may include a predicted temporal instance of when the gaming server 116 will invoke (e.g., due to an input by the player 112) the "In Service" mode at the gaming device 108 and maintain the gameplay session at the gaming device 108 (e.g., as in 455 of the process flow 400).

At 525, the gaming server 116 may make the "Out of Service" mode available for the player 112 based on the data included in the output from the machine learning network. For example, the gaming server 116 may enable selection of the "Out of Service" mode based on the predictions. In an example, the gaming server 116 may enable selection of the "Out of Service" mode after a quantity of plays, a temporal duration, a loss amount, a win amount, a consecutive quantity of winning bets, a consecutive quantity of losing bets, etc. indicated in the predictions generated at 515. In some aspects, the gaming server 116 may enable selection of the "Out of Service" mode based on whether the probability score and/or confidence score associated with a prediction exceeds a respective threshold.

At 530, the gaming server 116 may output a notification indicating the availability of the "Out of Service" mode with respect to the gaming device 108. In some aspects, the gaming server 116 may output the notification based on whether the probability score and/or confidence score associated with a prediction is equal to or greater than a respective threshold. In an example, the gaming device 108 may display the notification on a respective user interface. Alternatively, or additionally, a communication device 144 associated with the player 112 may display the notification on a respective user interface.

In some aspects, the notification output at 530 may include a predicted parameters value(s) (e.g., "Out of Service" mode duration) associated with invoking the "Out of Service" mode at the gaming device 108. In an example, the gaming server 116 may provide the predicted parameter value(s) (e.g., include the predicted parameter value(s) in the notification) based on whether a probability score and/or confidence score corresponding to a predicted parameter value(s) (e.g., a predicted temporal instance associated with invoking the "In Service" mode) exceeds a respective threshold.

At 535, the gaming server 116 may invoke the "Out of Service" mode at the gaming device 108 (e.g., as described at 410 of the process flow 400). In an example, the gaming server 116 may invoke the "Out of Service" mode based on a user input. In another example, the gaming server 116 may invoke the "Out of Service" mode autonomously and/or semi-autonomously, aspects of which are described below.

At 536, in an example case of an existing "Out of Service" mode invoked at a gaming device 108, the machine learning network (e.g., machine learning engine 141) may process user data including user behavior (e.g., player behavior, behavior of a casino operator, a floor attendant, or a restaurant employee, etc.) away from the gaming device 108 (e.g., player behavior tracked by a member or player tracking system, such as a meal purchase, checking into/out of a hotel room, casino operator actions implemented on behalf of a player, floor attendant actions implemented on behalf of a player, restaurant employee actions implemented on behalf of a player, etc.). The gaming server 116 may generate an output (e.g., predictions) of whether the user may request to extend the duration of the "Out of Service" mode. In some cases, the output may include temporal information associated with the extension. The temporal information may include, for example, a predicted temporal instance when the user will request the extension, a predicted duration indicated in the extension request, etc. In an example, the output from the machine learning network (e.g., machine learning engine 141) may include a probability score and/or confidence score associated with the predictions.

Alternatively, or additionally, at 536, in the example case of an existing "Out of Service" mode invoked at a gaming device 108, the machine learning network may generate an output including predictions that the player 112 may not resume the gameplay session at the gaming device 108. For example, the machine learning network may generate an output (e.g., predictions) of whether a user (e.g., player 112, casino operator, floor attendant, restaurant employee, etc.) may request to cancel the hold associated with the gaming device 108 (e.g., invoke the "In Service" mode and unlock the gaming device 108 for any player 112, without maintaining the gameplay session at the gaming device 108). In some cases, the output may include temporal information associated with the predicted request. The temporal information may include, for example, a predicted temporal instance when the user will request the to cancel the hold.

In another example, at 536, the machine learning network (e.g., machine learning engine 141) may generate an output (e.g., predictions) indicating the player 112 does not intend to resume the gameplay session at the gaming device 108, and that the user may refrain from inputting a request for cancelling the hold (e.g., the user may intentionally or unintentionally allow the duration of the "Out of Service" mode to expire). For example, based on tracked player behavior away from the gaming device 108 (e.g., a visit to a casino bar, a visit to a casino nightclub, check-in to the player 112's hotel room, etc.), the machine learning network may predict that the player 112 does not intend to resume the gameplay session at the gaming device 108. In an example, the output from the machine learning network may include a probability score and/or confidence score associated with the predictions described with reference to 536.

At 537, the gaming server 116 may receive the output (e.g., predictions) from the machine learning network (e.g., machine learning engine 141).

At 540, the gaming server 116 may output a notification inquiring whether the player would like to extend the duration of the "Out of Service" mode. In some aspects, the gaming server 116 may output the notification based on whether the probability score and/or confidence score associated with a prediction (e.g., a predicted request associated with extending the duration) is equal to or greater than a respective threshold. In an example, the gaming device 108 may display the notification on a respective user interface. Alternatively, or additionally, a communication device 144 associated with the player 112 may display the notification on a respective user interface.

At 545, the gaming server 116 may extend the duration of the "Out of Service" mode (e.g., as described at 430 of the process flow 400). In an example, the gaming server 116 may extend the "Out of Service" mode based on a player input associated with the notification output at 540. In another example, the gaming server 116 may extend the "Out of Service" mode autonomously and/or semi-autonomously, aspects of which are described below.

At 550, the gaming server 116 may output a notification inquiring whether the player would like to remove the hold from the gaming device 108 (e.g., invoke the "In Service" mode, without maintaining the gameplay session). In an example, the gaming server 116 may output the notification based on whether the probability score and/or confidence score associated with a prediction (e.g., a predicted request associated with invoking the "In Service" mode, a prediction that the user does not intend to resume the gameplay session) is equal to or greater than a respective threshold. In an example, the gaming device 108 may display the notification on a respective user interface. Alternatively, or additionally, a communication device 144 associated with the player 112 may display the notification on a respective user interface.

At 555, the gaming server 116 may invoke the "In Service" mode of the gaming device 108 and unlock the gaming device 108 for use by any player 112, without maintaining the gameplay session at the gaming device 108 (e.g., as described at 460 of the process flow 400).

According to example aspects of the present disclosure, the machine learning techniques of process flow 500 may support semi-autonomous and/or fully-autonomous implementations of any portion of the process flow 400 described with reference to FIG. 4. For example, the gaming server 116 may semi-autonomously (e.g., with partial user input or confirmation) set parameters of an "Out of Service" mode for a gaming device 108, invoke the "Out of Service" mode at the gaming device 108, modify (e.g., extend) a duration of the "Out of Service" mode of the gaming device 108, invoke a "In Service" mode of the gaming device 108, and/or transfer the "Out of Service" mode to from the gaming device 108 (e.g., gaming device 108-*a*) to another gaming device 108 (e.g., gaming device 108-*b*) based on whether a corresponding probability score and/or confidence score is equal to or greater than a first threshold.

In another example, the gaming server 116 may autonomously (e.g., without user input or confirmation) set parameters of an "Out of Service" mode for a gaming device 108, invoke the "Out of Service" mode at the gaming device 108, modify (e.g., extend) a duration of the "Out of Service" mode of the gaming device 108, invoke a "Return to Service" mode of the gaming device 108, and/or transfer the "Out of Service" mode to from the gaming device 108 (e.g., gaming device 108-*a*) to another gaming device 108 (e.g., gaming device 108-*b*) based on whether a corresponding probability score and/or confidence score is equal to or greater than a second threshold higher than the first threshold.

Figure 6:
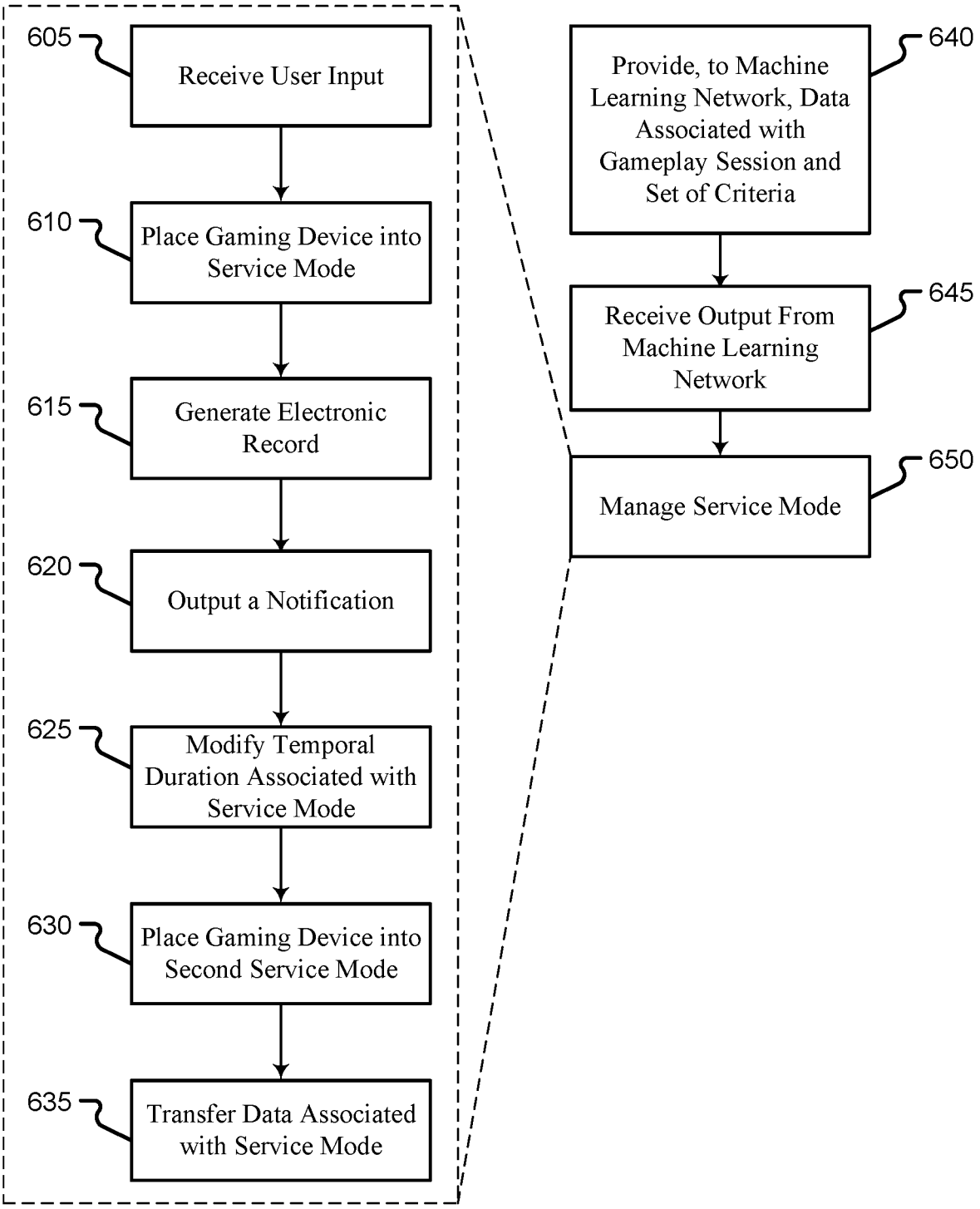
FIG. 6 is a process flow illustrating managing service modes of a gaming device in accordance with aspects of the present disclosure.

FIG. 6 illustrates an example of a process flow 600 that supports aspects of the present disclosure associated with taking a gaming device out of service (e.g., invoking the "Out of Service" mode), with or without intervention from a floor attendant. The process flow 600 further supports aspects of the present disclosure associated with returning the gaming device to service (e.g., invoking the "In Service" mode), without intervention from a floor attendant. In some examples, process flow 600 may implement aspects of gaming system 100. Further, process flow 600 may be implemented by a gaming system 100 or components included therein as described with reference to FIGS. 1 through 3.

In the following description of the process flow 600, the operations may be performed in a different order than the order shown, or the operations may be performed in different orders or at different times. Certain operations may also be left out of the process flow 600, or other operations may be added to the process flow 600. It is to be understood that any device (e.g., a gaming device 108, a gaming server 116, a communication device 144, components of the system 100, etc.) may perform the operations shown.

At 605, the gaming server 116 may receive a user input (e.g., an input from a player 112, an input from a floor attendant, etc.) that invokes, for a player 112, a service mode for a gaming device 108 during a gameplay session.

At 610, the gaming server 116 may place the gaming device 108 into the service mode. In an example, the service mode may include a temporary out-of-service mode. In some aspects, at 610, the gaming server 116 may set a temporal duration associated with the service mode based on satisfying a set of criteria.

At 615, the gaming server 116 may generate an electronic record based on invoking the service mode for the player 112. In some aspects, the electronic record may include a set of parameters associated with the service mode. In an example, the temporal duration may be included in the set of parameters associated with the service mode. In some aspects, the electronic record may include gameplay data corresponding to the gameplay session, and the gameplay data may include a quantity of plays associated with the gameplay session and/or a duration of the gameplay session.

At 620, the gaming server 116 may output a notification based on placing the gaming device 108 into the service mode. In some aspects, the notification may include information describing at least a portion of the electronic record. In some aspects, the information may include gameplay data corresponding to the gameplay session, and the gameplay data may include a quantity of plays associated with the gameplay session and/or a duration of the gameplay session.

In some aspects, at 625, the gaming server 116 may modify (e.g., extend) a temporal duration associated with the service mode based on a second player input. In some cases, the gaming server 116 may modify the temporal duration based on a difference value between an elapsed time and the temporal duration. In some aspects, the gaming server 116 may modify the temporal duration based on a user profile associated with the service mode (e.g., a membership status of the player 112, authorization level of a casino operator, a floor attendant, or a restaurant employee, etc.).

At 630, the gaming server 116 may place the gaming device 108 into a second service mode based on a second player input. In some aspects, the gaming server 116 may enable the second service mode based on an elapsed time exceeding a temporal duration associated with the service mode. The second service mode may include an in-service mode.

In an example, the second player input may include a redemption of an electronic ticket, a physical ticket, or both, the electronic ticket, the physical ticket, or both including at least a portion of the electronic record. In some cases, the electronic ticket, the physical ticket, or both may be generated (e.g., by the gaming server 116 and/or the gaming device 108) based on placing the gaming device 108 into the service mode. In an example, the electronic ticket, the physical ticket, or both may include at least a portion of the electronic record.

In some aspects, at 635, the gaming server 116 may transfer data associated with the service mode. The data associated the service mode may include data associated with the gameplay session and parameter values of the set of parameters associated with the service mode. For example, the second player input may include a redemption of the electronic ticket (or the physical ticket) at a different gaming device 108, and the gaming server 116 may transfer the data associated with the service mode to the different gaming device 108.

According to example aspects of the present disclosure, managing service modes at the gaming device 108 may be implemented in combination with a machine learning network (e.g., machine learning engine 141 described with reference to FIG. 1). For example, managing the service modes may include implementing any of 605 through 635 based on an output from a machine learning network.

For example, at 640, the gaming server 116 may provide, to the machine learning network, data associated with the gameplay session and a set of criteria associated with managing the service mode.

At 645, the gaming server 116 may receive an output from the machine learning network in response to the machine learning network processing the data with respect to the set of criteria. In some aspects, the output from the machine learning network may include an indication associated with managing the service mode and a predicted parameter value of the set of parameters associated with the service mode.

At 650, the gaming server 116 may manage the service mode based on the output from the machine learning network. In some aspects, managing the service mode may include: placing the gaming device 108 into a service mode (e.g., the out-of-service mode); setting a parameter value of the set of parameters; modifying the parameter value of the set of parameters; transferring the data associated with the service mode; and placing the gaming device 108 into a second service mode (e.g., the in-service mode).

In some aspects not illustrated in FIG. 6, the gaming system 100 may support training of the machine learning network (e.g., machine learning engine 141). For example, the gaming server 116 may train the machine learning network based on training data 143. In an example, the training data 143 may include: the set of criteria associated with managing the service mode; the data associated with the gameplay session; a parameter value selected by a player 112 and/or the machine learning network in association with the set of parameters associated with the service mode; a player input associated with modifying the parameter value; a player input associated with invoking a second service mode after the gaming device 108 has been placed into the service mode; and the output from the machine learning network. In another example, the training data 143 may include the set of criteria associated with managing the service mode; previous data associated with a previous gameplay session; a previous parameter value selected by a player 112 and/or the machine learning network in association with the set of parameters associated with the service mode; a player input associated with modifying the previous parameter value; a player input associated with a previous instance of invoking a second service mode after a previous instance of placing the gaming device 108 into the service mode; and a plurality of previous outputs by the machine learning network.

The term "a" or "an" entity refers to one or more of that entity. As such, the terms "a" (or "an"), "one or more," and "at least one" can be used interchangeably herein. It is also to be noted that the terms "comprising," "including," and "having" can be used interchangeably.

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Any combination of one or more computer readable media may be utilized. The computer readable media may be a computer readable signal medium or a computer readable storage medium. A computer readable storage medium may be, for example, but not limited to, an electronic, magnetic, optical, electromagnetic, or semiconductor system, apparatus, or device, or any suitable combination of the foregoing. More specific examples (a non-exhaustive list) of the computer readable storage medium would include the following: a portable computer diskette, a hard disk, a random access memory (RAM), a read-only memory (ROM), an erasable programmable read-only memory (EPROM or Flash memory), an appropriate optical fiber with a repeater, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device. Program code embodied on a computer readable signal medium may be transmitted using any appropriate medium, including but not limited to wireless, wireline, optical fiber cable, RF, etc., or any suitable combination of the foregoing.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to aspects of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

What is claimed is:

1. A system comprising:

a processor; and a computer-readable storage medium coupled with the processor, the computer-readable storage medium comprising processor-executable instructions that, when executed by the processor, cause the processor to:

receive a user input that invokes, for a player, a service mode for a gaming device during a gameplay session;

provide, to a machine learning network:

data associated with the gameplay session; and a set of criteria associated with managing the service mode;

receive an output from the machine learning network in response to the machine learning network processing the data with respect to the set of criteria;

manage the service mode based at least in part on the output from the machine learning network, wherein managing the service mode comprises placing the gaming device into the service mode;

generate an electronic record based at least in part on invoking the service mode for the player, wherein the electronic record comprises a set of parameters associated with the service mode; and output a notification based on placing the gaming device into the service mode, wherein the notification comprises information describing at least a portion of the electronic record.

2. The system of claim 1, wherein the information comprises:

gameplay data corresponding to the gameplay session, the gameplay data comprising a quantity of plays associated with the gameplay session and/or a duration of the gameplay session.

3. The system of claim 1, wherein the service mode comprises a temporary out-of-service mode.

4. The system of claim 1, wherein the instructions further cause the processor to:

set a temporal duration associated with the service mode based at least in part on satisfying a set of criteria, wherein the temporal duration is comprised in the set of parameters associated with the service mode.

5. The system of claim 1, wherein the instructions further cause the processor to:

place the gaming device into a second service mode based at least in part on:

a second player input; and an elapsed time exceeding a temporal duration associated with the service mode.

6. The system of claim 5, wherein the second service mode comprises an in-service mode.

7. The system of claim 5, wherein the second player input comprises:

a redemption of an electronic ticket, a physical ticket, or both, the electronic ticket, the physical ticket, or both comprising at least a portion of the electronic record.

8. The system of claim 1, wherein:

an electronic ticket, a physical ticket, or both is generated based at least in part on placing the gaming device into the service mode, the electronic ticket, the physical ticket, or both comprising at least a portion of the electronic record.

9. The system of claim 1, wherein the instructions further cause the processor to:

modify a temporal duration associated with the service mode based at least in part on:

a second player input;

a difference value between an elapsed time and the temporal duration; and a user profile associated with the service mode, wherein the temporal duration is comprised in the set of parameters associated with the service mode.

10. The system of claim 1, wherein the instructions further cause the processor to:

transfer data associated with the service mode, wherein the data associated the service mode comprises:

data associated with the gameplay session; and parameter values of the set of parameters associated with the service mode.

11. The system of claim 1, wherein the output from the machine learning network comprises:

an indication associated with managing the service mode; and a predicted parameter value of the set of parameters associated with the service mode.

12. The system of claim 1, wherein managing the service mode comprises:

setting a parameter value of the set of parameters;

modifying the parameter value of the set of parameters;

transferring the data associated with the service mode; and placing the gaming device into a second service mode.

13. The system of claim 1, wherein the instructions further cause the processor to:

train the machine learning network based at least in part on training data, the training data comprising:

the set of criteria associated with managing the service mode;

the data associated with the gameplay session;

a parameter value selected by a player and/or the machine learning network in association with the set of parameters associated with the service mode;

a player input associated with modifying the parameter value;

a player input associated with invoking a second service mode after the gaming device has been placed into the service mode; and the output from the machine learning network.

14. The system of claim 1, wherein the instructions further cause the processor to:

train the machine learning network based at least in part on training data, the training data comprising:

the set of criteria associated with managing the service mode;

previous data associated with a previous gameplay session;

a previous parameter value selected by a player and/or the machine learning network in association with the set of parameters associated with the service mode;

a player input associated with modifying the previous parameter value;

a player input associated with a previous instance of invoking a second service mode after a previous instance of placing the gaming device into the service mode; and a plurality of previous outputs by the machine learning network.

15. A device comprising:

a communication interface;

a processor coupled with the communication interface; and a computer-readable storage medium coupled with the processor, the computer-readable storage medium comprising processor-executable instructions that, when executed by the processor, cause the processor to:

receive a user input that invokes, for a player, a service mode for a gaming device during a gameplay session;

provide, to a machine learning network:

data associated with the gameplay session; and a set of criteria associated with managing the service mode;

receive an output from the machine learning network in response to the machine learning network processing the data with respect to the set of criteria;

manage the service mode based at least in part on the output from the machine learning network, wherein managing the service mode comprises placing the gaming device into the service mode;

generate an electronic record based at least in part on invoking the service mode for the player, wherein the electronic record comprises a set of parameters associated with the service mode; and output a notification based on placing the gaming device into the service mode, wherein the notification comprises information describing at least a portion of the electronic record.

16. The device of claim 15, wherein the information comprises:

gameplay data corresponding to the gameplay session, the gameplay data comprising a quantity of plays associated with the gameplay session and/or a duration of the gameplay session.

17. The device of claim 15, wherein the service mode comprises a temporary out-of-service mode.

18. A method comprising:

receiving a user input that invokes, for a player, a service mode for a gaming device during a gameplay session;

providing, to a machine learning network:

data associated with the gameplay session; and a set of criteria associated with managing the service mode;

receiving an output from the machine learning network in response to the machine learning network processing the data with respect to the set of criteria;

managing the service mode based at least in part on the output from the machine learning network, wherein managing the service mode comprises placing the gaming device into the service mode;

generating an electronic record based at least in part on invoking the service mode for the player, wherein the electronic record comprises a set of parameters associated with the service mode; and outputting a notification based on placing the gaming device into the service mode, wherein the notification comprises information describing at least a portion of the electronic record.

19. The method of claim 18, wherein the information comprises:

gameplay data corresponding to the gameplay session, the gameplay data comprising a quantity of plays associated with the gameplay session and/or a duration of the gameplay session.

20. The method of claim 18, wherein the service mode comprises a temporary out-of-service mode.

* * * * *